US005424752A

United States Patent [19]

Yamazaki et al.

[11] Patent Number: 5,424,752

[45] Date of Patent: Jun. 13, 1995

[54] METHOD OF DRIVING AN ELECTRO-OPTICAL DEVICE

[75] Inventors: Shunpei Yamazaki, Tokyo; Akira Mase, Aichi; Masaaki Hiroki; Yasuhiko Takemura, both of Kanagawa, all of Japan

[73] Assignee: Semiconductor Energy Laboratory Co., Ltd., Kanagawa, Japan

[21] Appl. No.: 161,094

[22] Filed: Dec. 3, 1993

Related U.S. Application Data

[63] Continuation of Ser. No. 889,914, May 29, 1992, abandoned, which is a continuation-in-part of Ser. No. 758,904, Sep. 11, 1991, Pat. No. 5,165,075.

[30] Foreign Application Priority Data

May 31, 1991 [JP] Japan ..... 3-157506
Jun. 7, 1991 [JP] Japan ..... 3-163873
Jun. 14, 1991 [JP] Japan ..... 3-169309

[51] Int. Cl.[6] ..... G09G 3/36
[52] U.S. Cl. ..... 345/92; 345/93
[58] Field of Search ..... 340/784, 793, 805, 767; 358/236, 240, 241; 345/90, 93, 92

[56] References Cited

U.S. PATENT DOCUMENTS 4,006,298 2/1977 Fowler et al. ..... 358/240
4,455,576 6/1984 Hoshi ..... 358/236 X
4,709,995 12/1987 Kuribayashi et al. ..... 340/793 X
4,742,346 5/1988 Gillette et al. ..... 340/784 X
4,743,096 5/1988 Wakai et al. ..... 340/784 X
4,752,774 6/1988 Clerc et al. ..... 340/793 X
4,766,430 8/1988 Gillette et al. ..... 340/784 X
4,769,713 9/1988 Yasui ..... 340/793 X
4,872,059 10/1989 Shinabe ..... 358/236 X
5,075,683 12/1991 Ghis ..... 340/793
5,165,075 11/1992 Hiroki et al. ..... 340/784 X
5,172,108 12/1992 Wakabayashi et al. ..... 340/79

*Primary Examiner*—Jeffery A. Brier
*Attorney, Agent, or Firm*—Sixbey, Friedman, Leedom & Ferguson; Gerald J. Ferguson, Jr.; Evan R. Smith

[57] ABSTRACT

A method of fine intermediate gradation display by an electro-optical device, with little difference in devices is disclosed. In case of driving each picture element of an active matrix electro-optical device, a visual intermediate gradation display can be carried out by using a modified transfer gate complementary field effect device, in a structure where one of input/output terminal thereof is connected with a picture element electrode, by applying a bipolar pulse to its control electrode in a cycle and by applying voltage to the other input/output terminal, or by cutting voltage at the same time, and whereby digitally controlling duration of voltage applied to the picture element.

21 Claims, 24 Drawing Sheets

$Z_{n,m}$ : $T_1 + 4T_1 = 5T_1 \rightarrow$ "5"
$Z_{n+1,m}$ : $2T_1 \rightarrow$ "2"
$Z_{n,m+1}$ : $2T_1 + 4T = 6T_1 \rightarrow$ "6"
$Z_{n+1,m+1}$ : $T_1 + 2T_1 = 3T_1 \rightarrow$ "3"

FIG. 11(D')
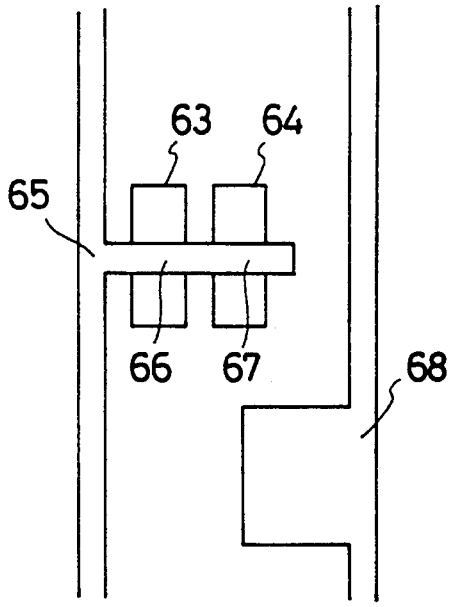
FIG. 11(E')
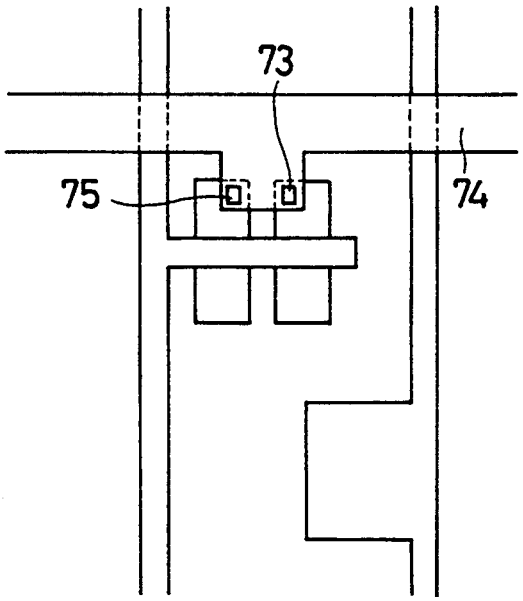
FIG. 11(F')
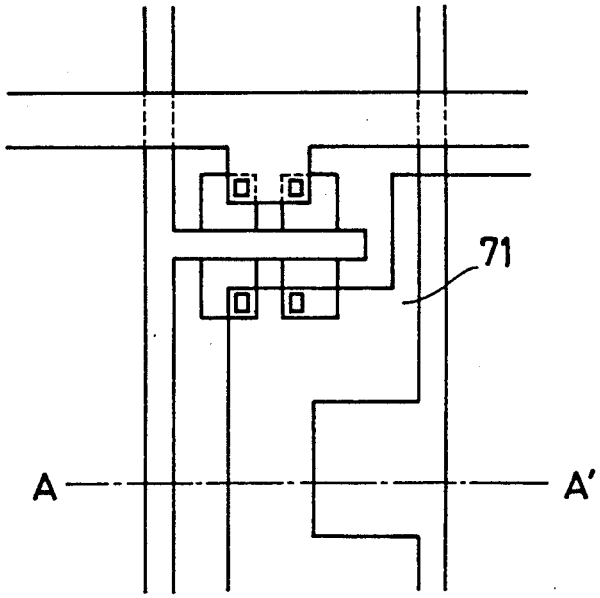
FIG. 11(G)
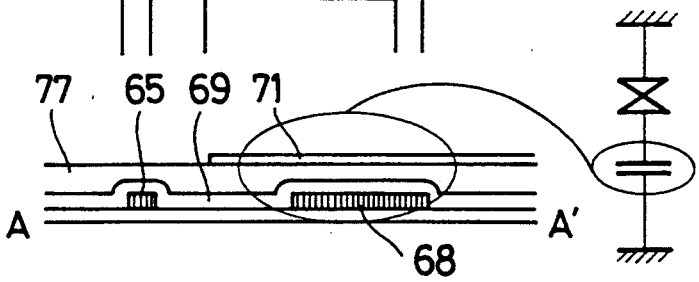

nTFT
A-A' CROSS SECTION
pTFT
B-B' CROSS SECTION

13
①
22

9
②
21

18
20

10
12
11
61
③
11

66
④
65

69
⑥
72
71
⑤

⑦
17
50

METHOD OF DRIVING AN ELECTRO-OPTICAL DEVICE

This application is a Continuation of Ser. No. 07/889,914, filed May 29, 1992, now abandoned, which is a continuation-in-part of Ser. No. 7/758,904 filed Sep. 11, 1991, now issued as U.S. Pat. No. 5,165,075.

BACKGROUND OF THE INVENTION 1. Field of The Invention

The present invention relates to a method of driving an electro-optical device utilizing a liquid crystal and the like for intermediate gradation image display.

2. Description of The Prior Art

A liquid crystal composition can easily be oriented in a parallel direction or in a vertical direction to an external electric field existing outside thereof, because the dielectric constant of the liquid crystal composition in a direction parallel to the molecule axis thereof is different from that in a direction vertical to the molecule axis. The ON/OFF display, i.e. the display in a degree of brightness, is carried out by taking advantage of the anisotropy in dielectric constant, and whereby controlling the amount of transmitted light or the degree of light dispersion. As a liquid crystal material, TN (twisted nematic) liquid crystal, STN (super-twisted nematic) liquid crystal, ferroelectric liquid crystal, antiferroelectric liquid crystal, polymer liquid crystal or dispersion liquid crystal are conventionally known. It is known that it takes a certain period of time before a liquid crystal responds to an external voltage, rather than an infinitely short period of time. The value of the response time is proper to each liquid crystal material: in case of TN liquid crystal, it is several 10 msec, while in case of STN liquid crystal, it is several 100 msec, and in case of ferroelectric liquid crystal, it is several 100 microsec, while in case of dispersion or polymer liquid crystal, it is several 10 msec.

Of the electro-optical device utilizing liquid crystal, a method of obtaining the most excellent image quality is the one taking advantage of an active matrix method. In case of a conventional active matrix type liquid crystal electro-optical device, a thin film transistor (TFT) was used as an active device, while amorphous or polycrystalline semiconductor was used for TFT, and either P-type or N-type TFT is utilized for one picture element. Namely, an N-channel TFT (also referred to as NTFT) is generally connected to a picture element in series. The NTFTs are provided at the intersections of the signal lines arranged in a matrix form. The ON/-OFF of a liquid crystal picture element is controlled by taking advantage of the fact that a TFT is turned in an ON state when signals are applied to the TFT through the two signal lines connected thereto. By thus controlling the picture element, a liquid crystal electro-optical device of large contrast can be achieved.

In case of the active matrix method as mentioned above, however, gradation display of brightness or color tone was very hard to carry out. Actually, a method utilizing the fact that the light transmission of liquid crystal is varied dependent upon the level of voltage applied thereto, was under examination. This meant, for example, that a proper level of voltage was supplied between the source and the drain of the TFT in a matrix, from a peripheral circuit, and that the same level of voltage was applied to a liquid crystal picture element by applying a signal voltage to a gate electrode under the condition.

In case of the abovementioned method, however, the voltage actually applied to the liquid crystal differed by at least several % in individual picture elements, owing to inhomogeneity of the TFT or to the inhomogeneity of a matrix wiring. On the other hand, the voltage dependency of light transmission of a liquid crystal has an extremely strong non-linear characteristic, and light transmission would drastically differs for the difference even by several % for the light transmission will change drastically at a certain voltage. For this reason, a 16 gradation was practically an upper limit.

The difficulty in carrying out gradation display was an enormous drawback of a liquid crystal display device in terms of competitiveness with a CRT (cathode-ray tube) method as a conventional and general display device.

BRIEF SUMMARY OF THE INVENTION

An object of the present invention is to propose a completely novel method of gradation display which has been conventionally difficult. The present invention relates to the method of gradation display by a liquid crystal electro-optical device utilizing a thin film transistor (hereinafter referred to as TFT) as a switching device for driving, and, in particular, to the method of gradation display for achieving the expression through neutral color tone as well as intermediate brightness. The present invention relates, in particular, to the complete digital gradation display for carrying out gradation display without applying any external analog signal to an active device. The gradation display in accordance with the present invention is carried out by using a transfer gate complementary field effect thin film transistors (CMOS) as active devices for driving a picture element, and by applying a high-speed signal to the active devices, and whereby digitally controlling the duration of a voltage applied to the picture element.

DETAILED DESCRIPTION OF THE PREFERRED EMBODIMENTS

As mentioned above, light transmission can be controlled by controlling the voltage to be applied to a liquid crystal, whereas the present inventors found out that a gradation can be obtained visually by controlling the duration of voltage application to the liquid crystal.

Figure 1A:
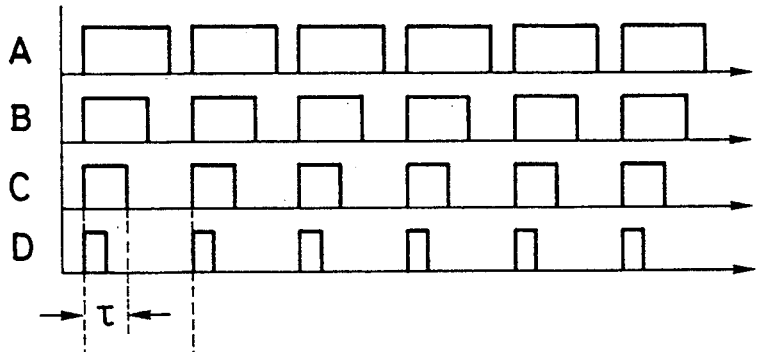
FIG. 1 shows an example of a drive waveform in accordance with the present invention.
Figure 1B:
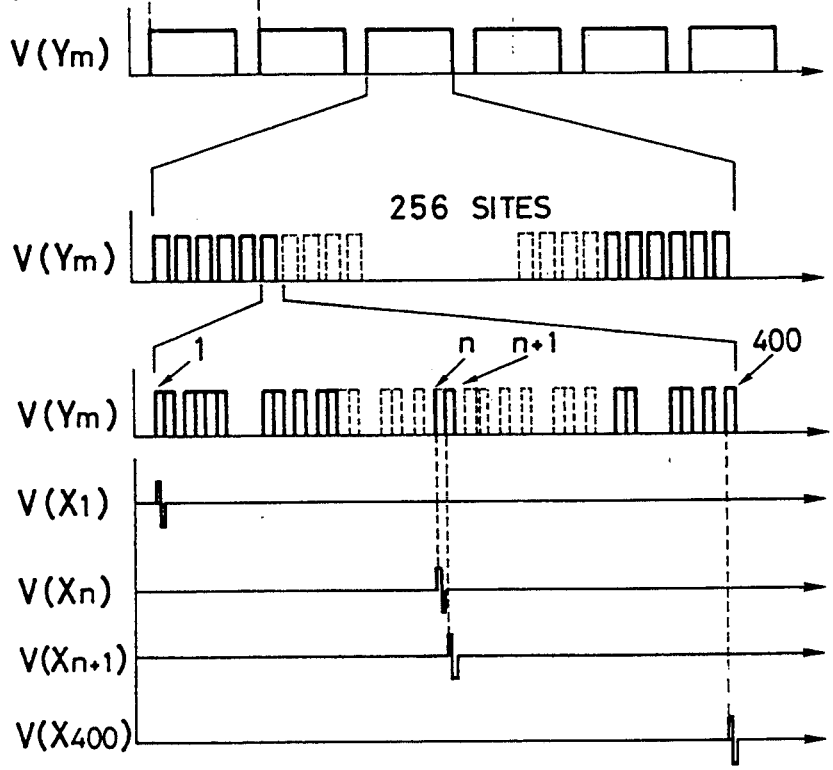

For example, in case of using a TN (twisted nematic) liquid crystal which is a liquid crystal material typically used, for a picture element (pixel) designed to be in a normally black mode or the (dark) mode with no light transmission under a condition where no voltage was applied to a liquid crystal cell, when a case of applying a rectangular pulse shown in FIG. 1(*a*) A to the picture element is compared with a case of applying a rectangular pulse as shown in C (in FIG. 1(*a*)), it was proved that the case A is brighter. The cycle (period) of the pulse was 1 msec. As a result, the case A was the brightest, followed by B, C, and D. For a picture element designed to be in a normally white mode in reverse to the normally black mode, i.e. in a mode that shows a bright state under no application of a voltage to a liquid crystal picture element (pixel), the case A was the darkest, followed by B, C, D, in reverse to the above case.

The fundamental principle for this phenomenon has not yet been found out in detail, however, the present inventors found out that the gradation expression is possible by taking advantage of this phenomenon. Namely, intermediate brightness can be achieved through digital control by controlling the width of a pulse to be applied to a liquid crystal material in such a cycle (period) that the liquid crystal material does not react, which is a highlight of the present invention. As a result of the research carried out by the present inventors, the cycle (period) of the pulse for obtaining the intermediate brightness should be not more than 10 msec, preferably not more than 1 msec in case of TN liquid crystal.

The definition of the terminology of the cycle of a pulse is clarified here. In this case where a plurality of pulses are successively applied to a liquid crystal, the cycle of the pulse means a period of time from the time when one pulse starts to the time when a following next pulse starts. Namely, the cycle of a pulse is reciprocal of a pulse repetition frequency.

A pulse width means duration of a pulse in a voltage state. Namely, in FIG. 1, for example, in case of the pulse train in C, T is the cycle (period) of a pulse, while $\tau$ is a pulse width.

As is common in the art, counter variables such as n and i will be used herein to denote, for example, an nth or ith occurrance of a pulse. Those skilled in the art will appreciate that counter variables n and i will be natural numbers.

The same effect as this was obtained by using STN liquid crystal, or ferroelectric liquid crystal, or antiferroelectric liquid crystal, or even by using a polymer liquid crystal or dispersion liquid crystal. In any case, it was proved that a neutral color tone was obtained by applying the pulse of cycle (period) shorter than the response time of the liquid crystal. The gradation display was obtained by applying the pulse of a cycle (period) of not more than 100 msec in case of STN liquid crystal, or preferably not more than 10 msec, and not more than 100 microsec in case of ferroelectric or antiferroelectric liquid crystal, or preferably not more than 10 microsec, while not more than 10 msec or preferably not more than 1 msec in case of polymer liquid crystal or dispersion liquid crystal.

In general, a moving picture of an image of such as a television is formed out of 30 pieces of static pictures continuously fed in one second. The duration of the continuity of one static picture is thus approximately 30 msec. This duration is too fast for a human sight: the time cannot be caught by eyes, and it is consequently impossible to visually discriminate the static pictures one by one. In any way, one static picture cannot be continued for no less than 100 msec, in order to obtain a normal moving picture.

When a gradation display of 256 gradations is to be performed in accordance with the present invention, in case of T=3 msec, the time 3 msec should be divided into at least 256, in the method of pulse voltage application to be adopted as a method of applying voltage to a picture element. Namely, the circuit for applying a pulsed voltage of minimum 3 msec/256=11.7 microsec to a picture element, should be formed. In practice, the correlation between the duty ratio $\tau/T$ of the pulse and the light transmission (transmissivity) of a liquid crystal picture element is non-linear, and further fine control of the duty ratio of the pulse is required in order to obtain 256 gradations.

In addition, when an image display is to be actually carried out, other picture elements should be considered. There are actually as much as 400 lines in an image display device. Namely, as to be referred infra, ultra short responsibility of as short as 100 nsec is required for the active device of a matrix. The example of a circuit that has such a short-time responsibility is shown in FIGS. 7 and 8, which is explained infra.

Figure 7:
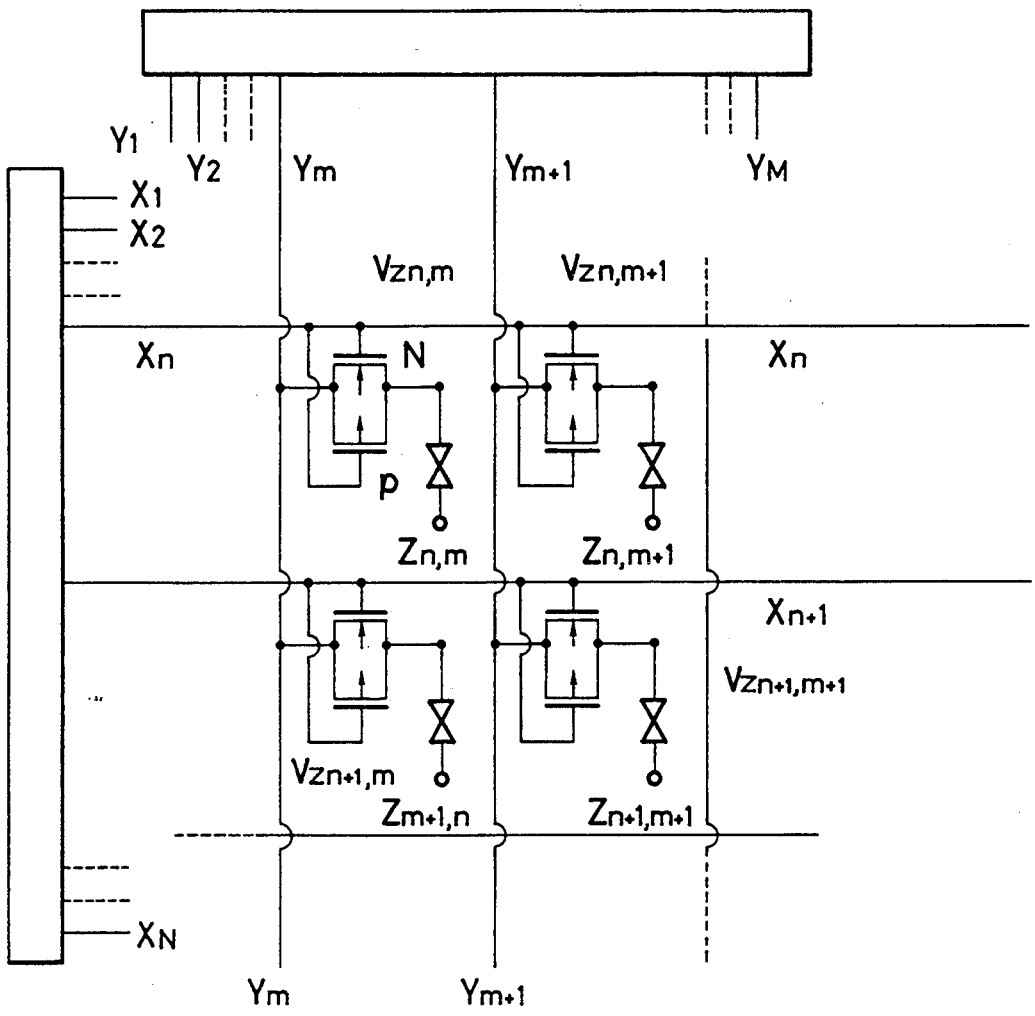
FIG. 7 shows an example of a matrix form in accordance with the present invention.
Figure 8:
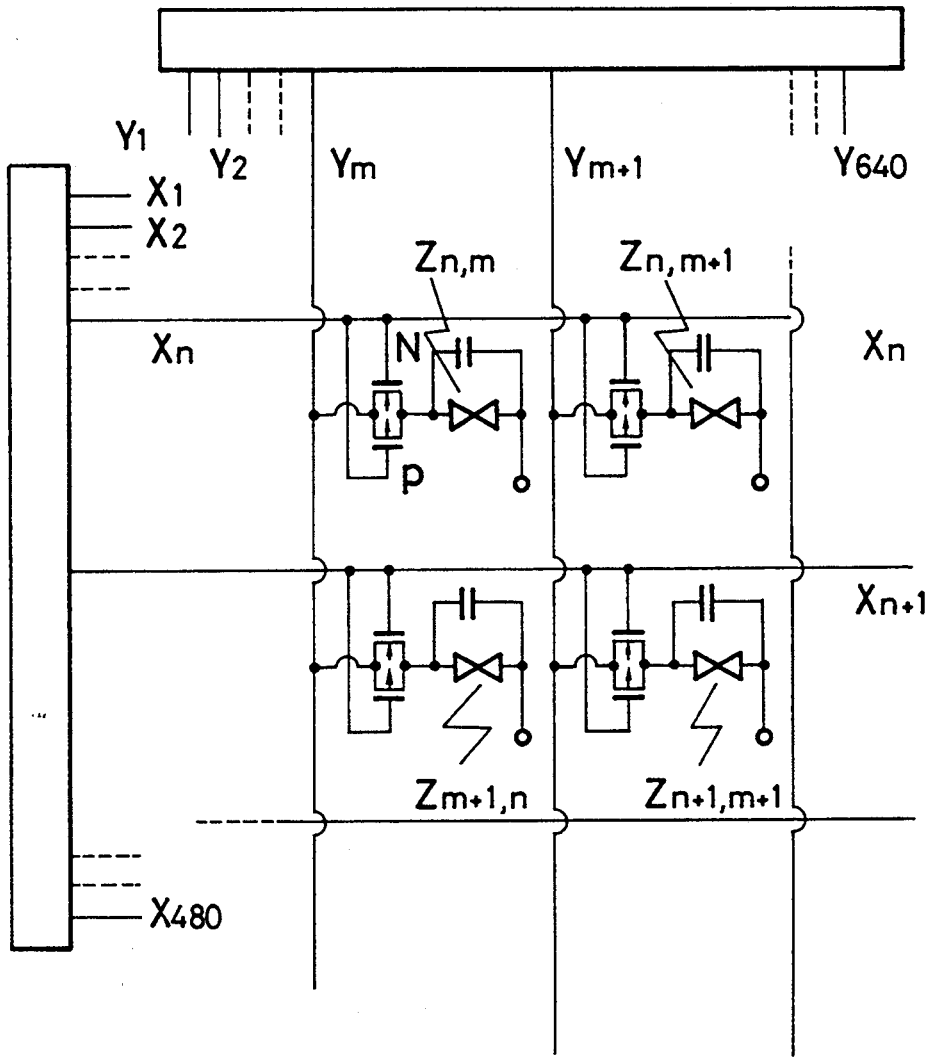
FIG. 8 shows an example of a matrix form in accordance with the present invention.

FIG. 7 shows an example of a circuit of an active matrix of a liquid crystal display device required to embody the present invention. Since the responsibility in a short period of time as short as 100 nsec or less is required for an active device, a circuit for high speed operation should be formed. For that purpose, a modified transfer gate type circuit should be used, which is formed out of NTFT and PTFT that are actuated in a complementary mode as shown in FIG. 7, not in a conventional individual mode of switching through either NTFT or PTFT.

A matrix of N×M is shown in this example, however, only the vicinity of n-row, m-column in the matrix is displayed in order to avoid complexity. The same pattern should be developed vertically and horizontally, in order to obtain a complete matrix.

FIG. 7 shows four modified transfer gates: a source of each modified transfer gate is connected to $Y_m$ or $Y_{m+1}$ (hereinafter collectively referred to as Y-line (data signal line)), while a gate of each modified transfer gate is connected to $X_n$ or $X_{n+1}$ (hereinafter collectively referred to as X-line (address signal line)). A drain of each modified transfer gate is connected to corresponding liquid crystal picture element $Z_{n,m}$, $Z_{n,m+1}$, $Z_{n+1,m}$, or $Z_{n+1,m+1}$. The positions of NTFT and PTFT can be replaced with each other in a modified transfer gate, in which they are symmetric.

A capacitor can be inserted intentionally in parallel with the capacitor of each picture element, as shown in FIG. 8. The inserted capacitor suppresses the reduction in voltage of the picture element due to natural discharge thereof, while the capacitor has the effect of suppressing the fluctuation of the electric potential of a liquid crystal by means of the capacitive coupling of an X-line and a liquid crystal picture element through the parasitic capacity generated between the gate and the drain. Regarding the latter effect, the level of fluctuating voltage is approximately proportional to the parasitic capacity between the gate and the source, and is in inverse proportion to the capacity of a liquid crystal picture element.

The capacity of a picture element can be controlled relatively easily in a liquid crystal display device, whereas the parasitic capacity is large in its difference, and when the capacity of a liquid crystal picture element is small, as in the case when the size of a liquid crystal cell is small, influence of the difference in the parasitic capacity is large, and the brightness can be thereby completely at random for each picture element. This leads to the deterioration in picture quality to be achieved by the invention such as the present invention designed to perform gradation display on the presumption that the voltage applied to a picture element is stable. It is thus important, to add a capacity in this manner, to increase the apparent capacity of liquid crystal picture element, and to suppress thereby the effect of the parasitic capacity of a gate, so as to maintain a constant level of the electric potential of liquid crystal.

High picture quality can be obtained also without inserting an intentional capacitor by adding an organic ferroelectric material such as tetrafluoroethylene, polyvinylidene fluoride to a picture element of such as a liquid crystal cell, and whereby increasing the electrostatic capacity of the picture element itself.

Since the adding of the capacitor, however, leads to the reduction in operating speed, the addition of excessive capacity is not desired. The level of the capacity to be added should be 10–100 times as large as the parasitic capacity of a gate, or 100 times as large as or less of the capacity of a liquid crystal element itself.

Referring to FIGS. 1(*b*) and 2, an example of operation of the circuit as described above is explained. The matrix circuit should be operated in such a way that a pulsed voltage as shown in FIG. 1(*a*) is applied to a liquid crystal cell. The outline of the signal voltage applied to X-line as well as Y-line so as to generate such a pulse, is shown in FIG. 1 (*b*). A matrix of 400×640 is assumed as an example.

For the signal applied to Y-line, or, for example, to $Y_m$, defined as $V(Y_m)$, there are 256 sites of pulses (hereinafter referred to as subpulse) in one group of pulses repeated in a cycle (period) T, and each of the 256 subpulses is composed of a pulse train that contains 400 elements. The number 400 corresponds to the number of lines (rows) of a matrix. The minimum unit of the pulse applied to Y-line is 29 nsec, in case of T=3 msec.

On the other hand, pulses which are reversed at least once in the polarity (hereinafter referred to as bipolar pulse) as shown in the figure in $V(X_1)$, $V(X_n)$, $V(X_{n+1})$, $V(X_{400})$, are applied to X-line in different timings for a time T/256. The bipolar pulse should be also shorter than the minimum unit pulse to be applied to the above-mentioned Y-line. As a result, bipolar pulses are applied 256 times to each X-line for a time T.

Figure 2:
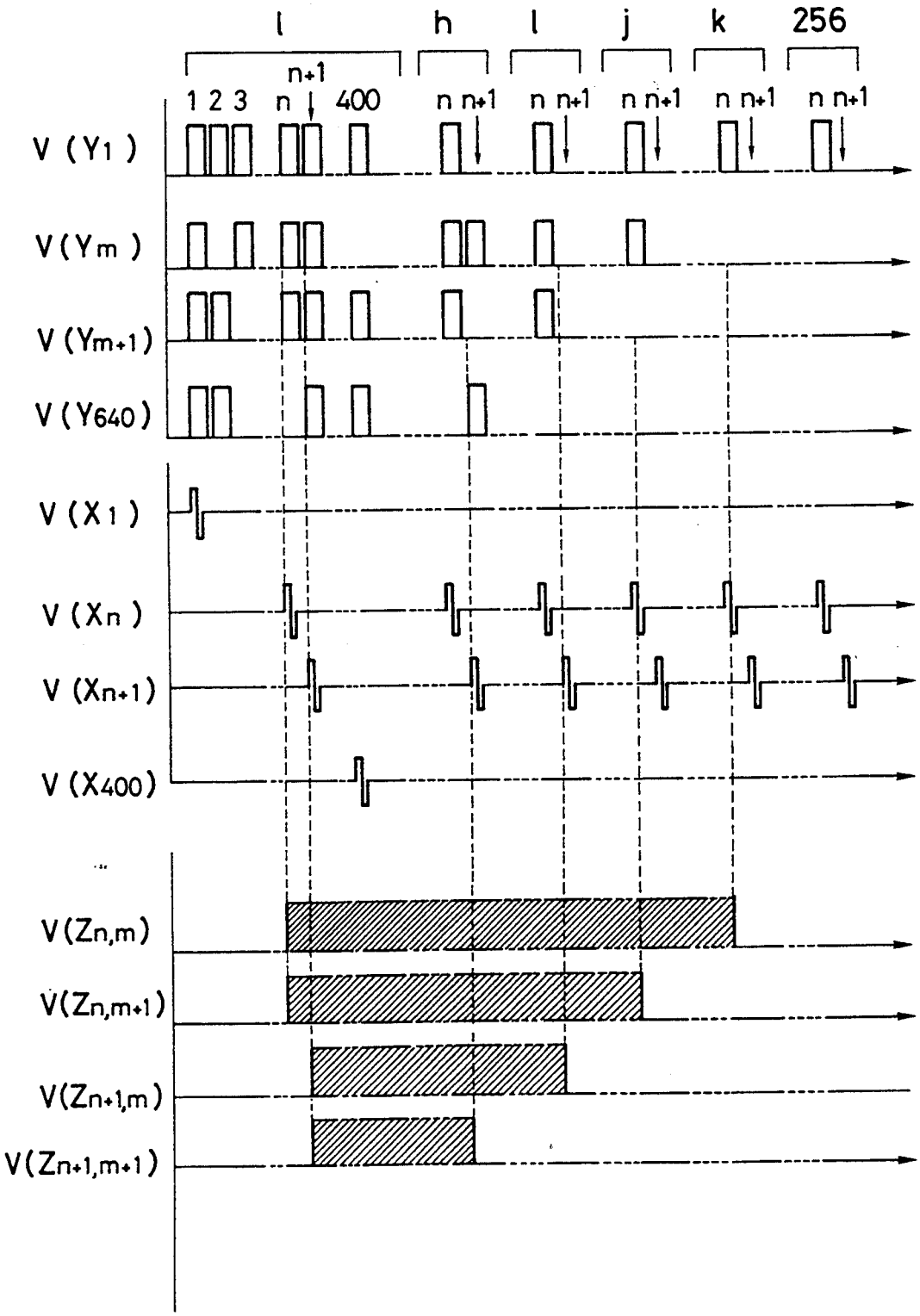
FIG. 2 shows an example of a drive waveform in accordance with the present invention.

Referring to FIG. 2, an actual operation of the circuit is explained infra. A first subpulse is applied to each Y-line. The subpulse should be different for each Y-line. On the other hand, bipolar pulses are applied to X-lines in order, e.g. at first to $X_1$, and then to $X_2$. First, it is presumed that a bipolar pulse is applied to $X_1$. The active device connected with a picture element $Z_{1,1}$ will be in an ON state. Since the Y-line connected with this active device is in a voltage-applied state, the picture element $Z_{1,1}$ will be charged. And, since the bipolar pulse is cut before the voltage of the Y-line reaches zero, a charge remains consequently in the picture element $Z_{1,1}$, and the voltage state is thus maintained. In the same manner, $Z_{1,m}$, $Z_{1,m+1}$, and $Z_{1,400}$ will be in voltage state.

It is presumed that bipolar pulses are applied in order in this manner, until a bipolar pulse is applied to $X_n$. When four picture elements $Z_{n,m}$, $Z_{n,m+1}$, $Z_{n+1,m+1}$ are observed, an n-th site and an (n+1)th site of the first subpulse of $Y_m$ as well as of $Y_{m+1}$ should be observed. Since there is a pulse in the nth site of $Y_m$ as well as of $Y_{m+1}$, the picture elements $Z_{n,m}$ and $Z_{n,m+1}$ will be in voltage state. A bipolar pulse is then applied to $X_{n+1}$. Since there is a pulse in the (n+1)th site of $Y_m$ as well as of $Y_{m+1}$, the picture elements $Z_{n+1,m}$ and $Z_{n+1,m+1}$ will be in charged state.

It is then presumed that a second subpulse comes, though this is omitted in the figure. When there is a pulse in the n-th site as well as in the (n+1)th site of $Y_m$ and of $Y_{m+1}$, the charged state is not canceled, and the abovementioned four picture elements continue to be in voltage state. It is also presumed that the four picture elements continued to be in voltage state, until a (h-1)th subpulse is applied thereafter.

It is then presumed that an h-th subpulse comes, in a series of subpulses. The pulses other than those in the n-th sites as well as the (n+1)th sites are omitted in the h-th subpulses in the figure to avoid complexity. Since there is a pulse in the n-th site of $Y_m$ as well as of $Y_{m+1}$, the picture elements $Z_{n,m}$ and $Z_{n,m+1}$ continue to be in voltage state. Since there is no pulse in the (n+1)th site of $Y_{m+1}$, while the picture element $Z_{n+1,m}$ continues to be in voltage state, the charge accumulated in the picture element $Z_{n+1,m+1}$ is ejected, and thereby the voltage state is stopped, since there is no supply of voltage thereto from outside under the condition that a gate is turned ON.

When an i-th subpulse comes, the voltage of the pulse in an (n+1)th of $Y_m$ is of zero level, the charged state of $Z_{n+1,m}$ is canceled thereby. The signals of an n-th of $Y_{m+1}$ as well as of $Y_m$ are of zero level, for the subpulses of a j-th as well as a k-th, and the charged states of the picture elements $Z_{n,m}$ and $Z_{n,m+1}$ are stopped during the application of the k-th and the j-th subpulses, respectively. The duration of voltage state can be digitally controlled for each picture element, as shown in FIG. 2, V(Z), through the process as mentioned above. The voltage V(Z) applied to the pixel electrode persists at least from time $T_1$ at which a signal applied to a Y-line for the first time after no signal application to the same Y-line ceases) to time $T_2$ (at which no signal applied to the same Y-line for the first time after the time $T_1$ starts).

By repeating the operation as mentioned supra, the width of the voltage pulse applied to each picture element can be controlled, as shown in FIG. 1(*a*).

In order to embody the present invention, the subpulse described above should not be necessarily in a pulse form that can be precisely defined so, as it is clear from the explanation supra. It is for the purpose of simplification that the concept of subpulse is referred to, and there may be no particular discrimination between one subpulse and another subpulse, and it is clear that the embodiment of the present invention is possible by using a signal which has substantially no boundary. In addition, a number of pulses included in the subpulse are not necessarily independent pulses, and they may be a series of signals comprising a combination of ON/OFF. Further, it is for the purpose of simplification that a voltage level of a signal and a zero level of a signal are referred, and this is not necessarily of absolute zero level, for the question is whether these are less than threshold voltage of liquid crystal or not. This principle applies to following cases.

The object of the abovementioned method of gradation display was to obtain neutral color tone as well as intermediate brightness by controlling the duration of voltage application to a picture element, and a number of pulses should be applied in a short period of time as is clear from FIG. 1(*b*). This increases the burden of a driving circuit for driving the display device. This defect is surmounted in an improved method of gradation display, which is described infra.

Figure 3:
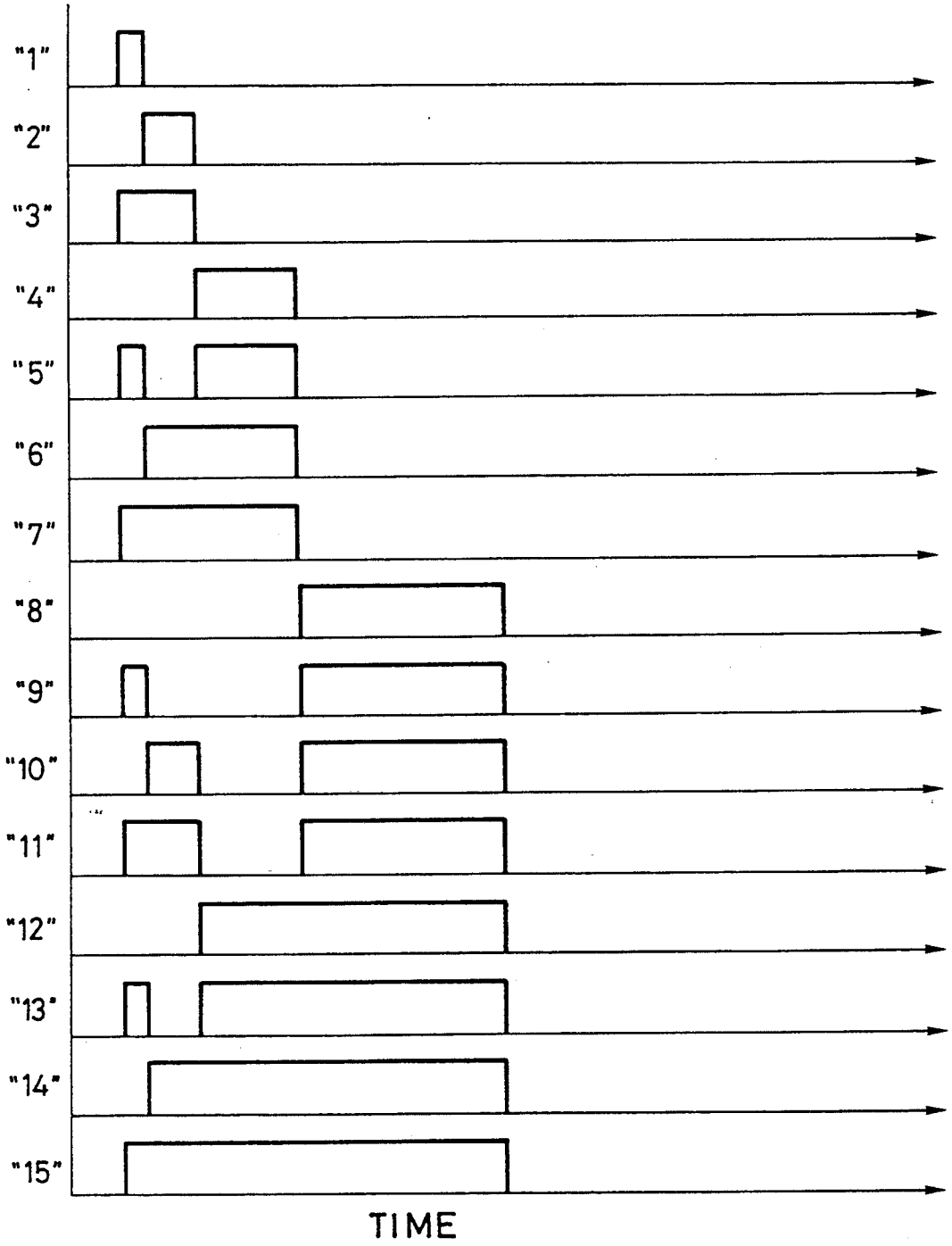
FIG. 3 shows an example of a drive waveform in accordance with the present invention.

In case of using, for example, a TN (twisted nematic) liquid crystal which is a liquid crystal material typically used, when the voltage of various pulse waveform as shown in FIG. 3 is applied to a liquid crystal picture element which is designed to be in a normally black mode, it was found that the brightness of the liquid crystal picture element differs correspondent to the different kind of pulses, and that the brightness can be stepwise varied thereby. This fact does not contradict the possible gradation display through changing a pulse width, as shown in FIG. 1(*a*) mentioned before. Namely, the duration of voltage applied to a liquid crystal picture element is different in each case of the example shown in FIG. 3, and an intermediate gradation display is considered to be achieved as a result of this.

Referring to FIG. 3, the brightness was varied stepwise from "1", "2", .... "15" in the order of brightness. Namely, a 16-gradation display is possible in the example shown in FIG. 3. For a picture element designed to be in a normally white mode, however, the level "1" is the brightest and "15" is the darkest. A pulse of the length of one unit is applied at "1", while a pulse of the length of two units is applied at "2". At "3", a pulse of the length of one unit as well as a pulse of the length of two units are applied, and at "4", a pulse of the length of four-unit is applied. A pulse of the length of one unit and a pulse of the length of four-unit are applied at "5", while a pulse of the length of two-unit as well as a pulse of the length of four-unit are applied at "6". By preparing a pulse of the length of eight units, a pulse of the maximum length of 15 units ("15") can be obtained.

The display of $2^4=16$ gradations is possible by appropriately coupling four kinds of pulses of one unit, two-unit, four-unit, and eight-unit, together. Further, advanced gradation display of 32-gradation, 64-gradation, 128-gradation, and 258-gradation are possible by preparing pulses of 16-unit, 32-unit, 64-unit, and 128-unit, respectively. In order to obtain 256 gradations display, for example, eight kinds,of pulses should be prepared.

Figure 5:
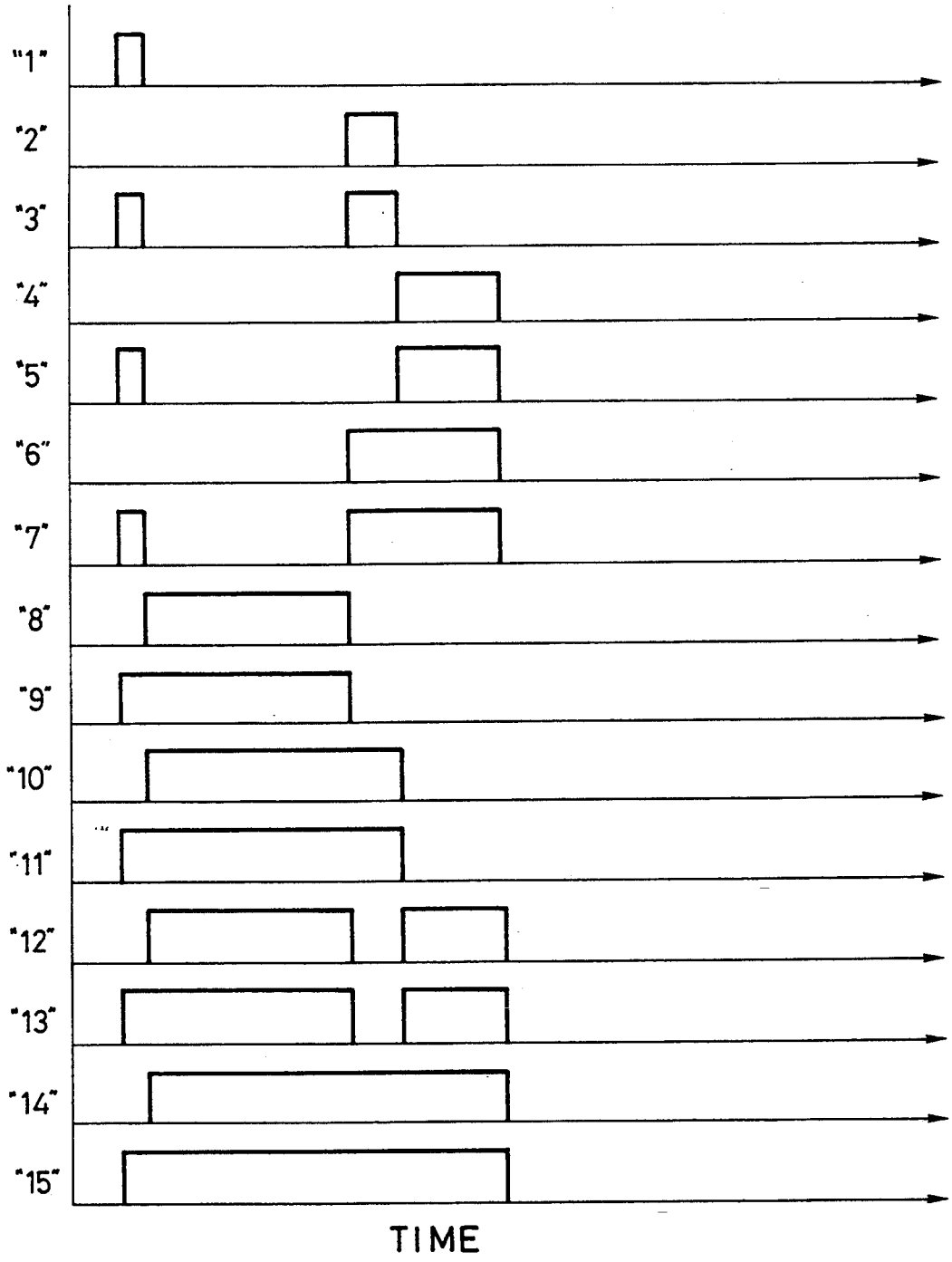
FIG. 5 shows an example of a drive waveform in accordance with the present invention.
Figure 6:
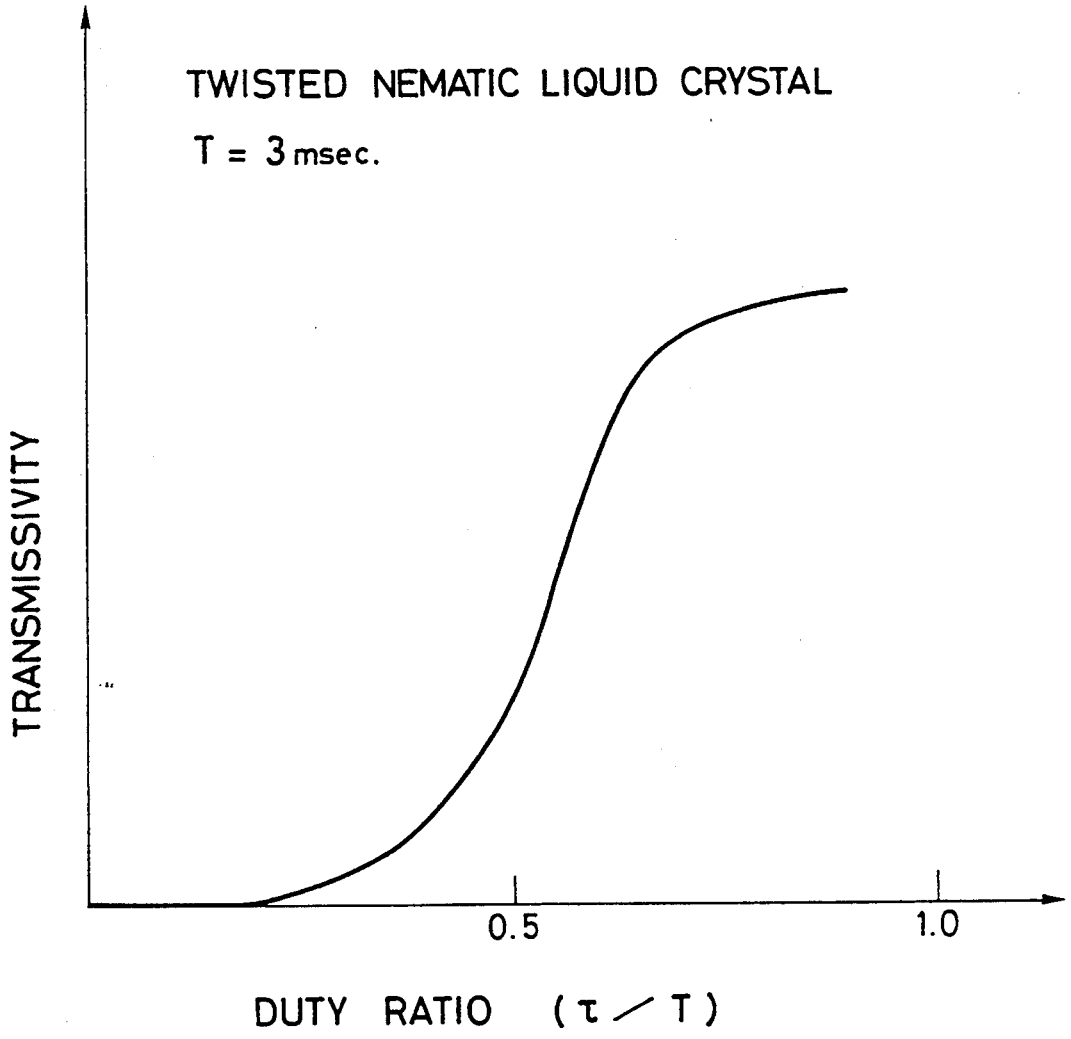
FIG. 6 shows an example of a gradation display characteristic in accordance with the present invention.

Referring to FIG. 3, the example of arrangement is shown, in which the duration of voltage applied to a picture element was increased in geometrical progression, in such a way as from $T_1$, to $2T_1$, and then to $4T_1$, however, this can be re-arranged as shown in FIG. 5, namely, from $T_1$, to $8T_1$, then $2T_1$, and finally to $4T_1$. The burden of a device for transmitting data to a display device can be reduced by changing arrangement in this manner.

As a suitable liquid crystal material for implementation of the abovementioned method, there are TN and STN liquid crystals, ferroelectric and antiferroelectric liquid crystals, and dispersion or polymer liquid crystal and so on. A pulse width of one unit will be slightly different for the liquid crystal material chosen therefrom, and, in case of TN liquid crystal material, the level of 10 nsec or more was appropriate.

In order to implement the present invention, a matrix utilizing the TFT as shown in FIG. 7 or FIG. 8 should be formed. An example of the operation of the matrix device is explained according to FIG. 4. The size of the matrix is presumed to be 640×480 dots.

Figure 4:
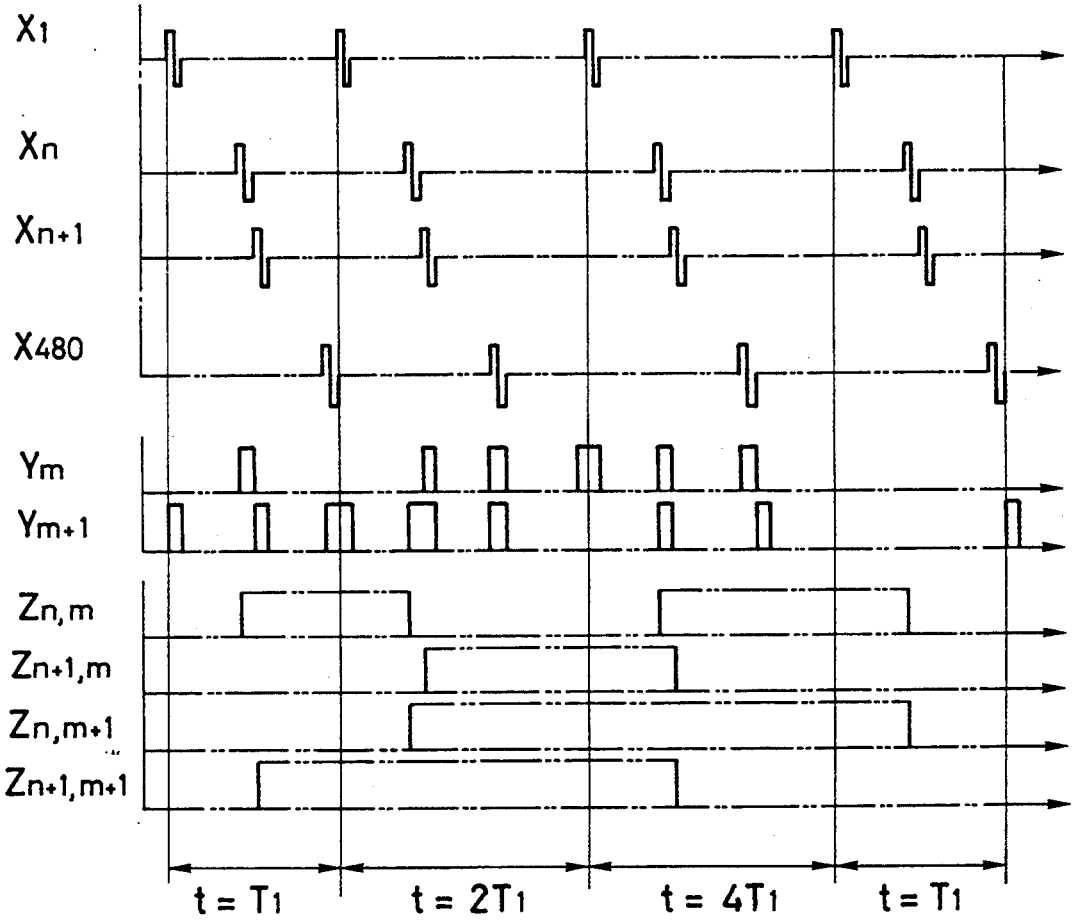
FIG. 4 shows an example of a drive waveform in accordance with the present invention.

Rectangular pulses which are once reversed in the polarity (hereinafter referred to as bipolar pulse) are applied to X-line in order, as shown in FIG. 4, while signals comprising a plurality of pulses are applied to Y-line.

In the following case, four picture elements $Z_{n,m}$, $Z_{n,m+1}$, $Z_{n+1,m}$, $Z_{n+1,m+1}$ are observed. Since the voltage of the picture element will not be changed unless signals comes both to X-line and to Y-line, in a modified transfer gate, signal lines $X_n$, $X_{n+1}$, and $Y_m$, and $Y_{m+1}$ are to be observed, in relation to the four picture elements.

It is presumed that a bipolar pulse is applied to $X_n$, as shown in the figure. While the abovementioned four picture elements are now observed, when the states of $Y_m$ as well as of $Y_{m+1}$ are observed, there is a signal in $Y_m$, whereas there is no signal in $Y_{m+1}$. The picture element $Z_{n,m}$ will consequently be in voltage state, and the picture element $Z_{n,m+1}$ in non-voltage state. Since the voltage state of the picture element is maintained by the capacitor thereof, by cutting the pulse of X-line before a next signal is applied to Y-line, the picture element $Z_{n,m}$ continues to be in voltage state. Basically the state of each picture element is continued until a next signal is applied to $X_n$.

A pulse is then applied to $X_{n+1}$. Since $Y_m$ is in non-voltage state and $Y_{m+1}$ in voltage state, as shown in the figure, at the time, the picture element $Z_{n+1,m}$ will be in non-voltage state, while the picture element $Z_{n+1,m+1}$ will be in voltage state, and each state is maintained as mentioned before.

When a second pulse is applied to the signal line $X_n$ after a time $T_1$ passes since a preceding pulse was applied thereto, since $Y_m$ is in non-voltage state and $Y_{m+1}$ in voltage state, the picture element $Z_{n,m}$ will be changed in a non-voltage state, while the picture element $Z_{n,m+1}$ is changed in a voltage state. An additional pulse is applied to $X_{n+1}$. While $Y_m$ as well as $Y_{m+1}$ are in voltage state, both of the picture elements $Z_{n+1,m}$ and $Z_{n+1,m+1}$ will be in voltage state. The picture element $Z_{n+1,m+1}$ continues to be in voltage state.

When a third pulse is applied to the signal line $X_n$ after a time $2T_1$ has passed, since both $Y_m$ and $X_{m+1}$ are in voltage state, the state of picture element $Z_{n,m}$ will be changed from a non-voltage state to a voltage state, and the picture element $Z_{n,m+1}$ continues to be in voltage state. An additional pulse is applied to $Y_{n+1}$. At this time, while both $Y_m$ and $Y_{m+1}$ are in non-voltage state both of the picture elements $Z_{n+1,m}$ and $Z_{n+1,m+1}$ will be in non-voltage state, and each voltage state ceases.

When a fourth pulse is applied to the signal line $X_n$ after a time $4T_1$ has passed, since both $Y_m$ and $Y_{m+1}$ are in non-voltage state, the state of both of the picture elements $Z_{n,m}$ and $Z_{n,m+1}$ will be changed from a voltage state to a non-voltage state. When an additional pulse is applied to $X_{n+1}$, since both $Y_m$ and $Y_{m+1}$ are in non-voltage state, both of the picture elements $Z_{n+1,m}$ and $Z_{n+1,m+1}$ continue to be in non-voltage state.

In this manner, one cycle (one screen) is completed. In this period of time, four bipolar pulses are applied to each X-line, while information signals (either in voltage state or in non-voltage state) of $3\times480=1440$ pieces are applied to each Y-line. A period of time of the one cycle is $8T_1$, and as a $T_1$, for example, a period of 10 nsec–10 msec is appropriate. When each picture element is observed, pulses of time $T_1$ as well as of $4T_1$are applied to the picture element $Z_{n,m}$ and the same effect as when a pulse of the length of $5T_1$ is applied, is visually obtained. Namely, a brightness of "5" is obtained. Consequently, the brightness of "2", "6", and "3" are obtained in the same manner, for the picture elements $Z_{n,m+1}$, $Z_{n+1,m}$, and $Z_{n+1,m+1}$, respectively.

While 8 gradations display is achieved in the above-mentioned example, more advanced gradation can be achieved by adding much more pulse signals. Advanced gradation of as much as 256 will be achieved by applying, for example, additional five pulses, whereby applying total nine pulses to each X-line in one cycle, and by applying information signals of $8\times480=3840$ pieces to each Y-line.

On the other hand, in order to achieve 258 gradations in the examples shown in FIGS. 1 and 2, as much as 258 pulses should be applied to each X-line in one cycle, and as much as $480\times258=122880$ information signals should be applied to each Y-line in one cycle, and the superiority of the present method is thus clear.

The choice between the method as shown in FIGS. 1, 2 and the method shown in FIGS. 3 to 5, is, however, dependent upon the characteristic of an intended display device, for a calculation process required in the present method is complicated.

Namely, in order to achieve a $2^K$ gradation in a matrix of N (the number of X-line)$\times$M (the number of Y-line), according to the method shown in FIGS. 1 and 2, as many as $2^K$ pulses should be applied to each X-line, and as many as $2^K\times N$ pulses to each Y-line, in order to form one cycle (one screen). According to the method as shown in FIGS. 3 to 5, however, $(K+1)$ times of pulses should be applied to each X-line, and $K\times N$ pulses to each Y-line, in order to form one cycle. As the number of gradations is increased, the superiority of the latter method is ensured. In case of low-level gradation such as four or eight gradations, however, there is not large difference in the number of pulses in either former or latter method, and, there is a case where the former method is advantageous when the complexity of calculation process in the latter method is taken into consideration.

In either case, in order to achieve particularly advanced high gradation display, extremely high-speed switching is required. In order to achieve 256 gradations, for example, since 30 or more moving pictures should be fed per second, which is translated in an expression $258T_1<30$ msec, the switching in $T_1<100$ microsec or shorter should be achieved. A pulse of the width of 200 nsec or shorter, for example, should be thus applied, when the display is composed of 480 X-lines (rows). The switching through a CMOS transfer gate circuit that allows for high-speed operation, is thus required, also for this reason.

Although a signal is discriminated either in voltage or in non-voltage state in the abovementioned explanation for better understanding, the only point is whether the signal level is no more or no less than a threshold voltage of liquid crystal or of TFT, as mentioned before. Also, there was no description concerning the counter electrode of a picture element, however, it is possible to apply the actual voltage to a picture element material both in positive and negative directions by applying proper bias voltage to the counter electrode of the picture element. Such an operation is necessary, for example, when a ferroelectric liquid crystal is to be used.

There was also no detailed description regarding a bipolar pulse, however, it should be clear that the height, width, or polarity, etc. of the pulse will be designed and varied according to each device, and that there will be no limitation to each value, according to the present invention. Namely, one bipolar pulse comprising two pulses having opposite polarities in accordance with the present invention may start a positive pulse or a negative pulse, with regard to the shape of a bipolar pulse, and the signals can be properly coupled with each other in terms of space and time, in the device. Regarding the width of a bipolar pulse, it is also not necessarily required to make the widths of the pulses of different polarities equal: The width can be varied correspondent to the mobility of NTFT or of PTFT, or a positive pulse can be longer, and a negative pulse shorter, and vice versa. Regarding the height of the pulse, a positive pulse can be higher, while a negative one lower, and vice versa. The decision on these values in detail is not the object of the present invention, and they should be decided by those who want to implement the present invention.

There was also no description concerning an alternating current technique which has been conventionally used, in the explanation supra, however, this technique is essential, in order to prevent the deterioration in liquid crystal, and since this technique does not contradict the present invention, it is indispensable. The technique is not required, however, if the deterioration caused by the factor such as electrolysis is very little, even when a d.c. current is applied.

Examples of manufacturing methods of preferred embodiments are described infra.

PREFERRED EMBODIMENT 1

In this embodiment, a wall mounted television set was manufactured by using the liquid crystal device utilizing the circuit structure as shown in FIG. 7, which will be described infra. Polycrystalline silicon that received laser annealing was used for TFT at the time of manufacturing.

Figure 9:
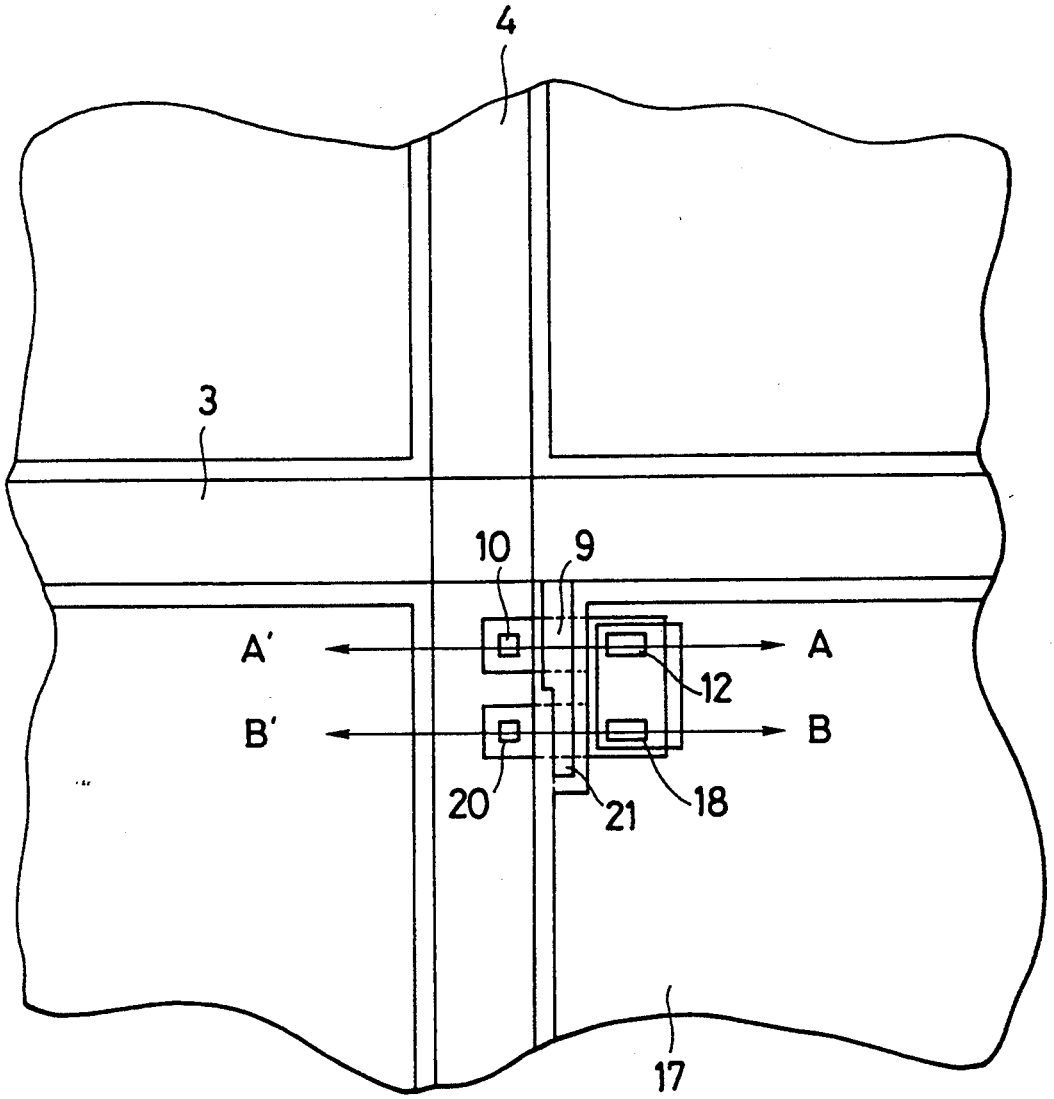
FIG. 9 shows a schematic diagram of a device in accordance with the preferred embodiment.
Figure 11A:
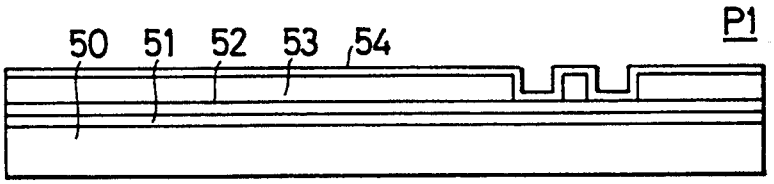
FIG. 11 shows a process of TFT in accordance with the preferred embodiment.
Figure 11B:
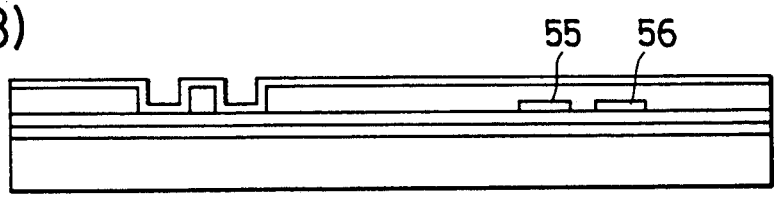

The actual arrangement or structure of electrodes etc. corresponding to this circuit structure is shown in FIG. 9, for one picture element. The manufacturing method of the liquid crystal panel used in the first preferred embodiment will be first explained with reference to FIG. 11. Referring to FIG. 11(A), a silicon oxide film was manufactured at a thickness of 1000–3000 angstroms as a blocking layer 51 by magnetron RF(high frequency) sputtering, on a glass substrate 50, which is not expensive such as quartz, and which can bear the thermal treatment of no more than 700° C., for example, approximately 600° C., under the process conditions as follows: in a 100% oxygen atmosphere; the temperature of film formation was 150° C.; output was 400–800 W; and pressure was 0.5 Pa. The rate of film formation was 30–100 angstroms/minute when quartz or single crystalline silicon was used as a target.

A silicon film 52 was manufactured thereon by plasma CVD. The temperature for film formation was 250–350 ° C., or 320° C. in this preferred embodiment, and mono-silane ($SiH_4$) was used. Besides mono-silane ($SiH_4$), disilane ($Si_2H_6$) or trisilane ($Si_3H_8$) may be used. These were introduced into a PCVD device at a pressure of 3 Pa, and the film was formed by applying high frequency power of 13.56 MHz. At the time, high frequency power should be 0.02–0.10 W/cm$^2$, or 0.055 W/cm$^2$ in this preferred embodiment. The flow rate of mono-silane ($SiH_4$) was 20SCCM, and the rate of film formation was approximately 120 angstroms/minute at the time. Boron may be added to the film at a concentration of $1\times10^{15}-1\times10^{18}cm^{-3}$ by means of diborane during the film formation, so as to set the threshold voltages (Vth) for PTFT and NTFT to almost an equal level. Sputtering or low pressure CVD may be employed instead of the plasma CVD for the formation of the silicon layer which will be a channel region of TFT, which will be described below in a simplified manner.

In case of sputtering, a single crystalline silicon was used as a target, and the sputtering was carried out in the atmosphere of 20–80% of hydrogen mixed with argon, with the back pressure before sputtering defined no more than $1\times10^{-5}$ Pa: e.g. 20% of argon and 80% of hydrogen; the temperature for film formation was 150° C.; frequency was 13.56 MHz; sputtering output was 400–800 W; and, pressure was 0.5 Pa.

In case of employing low pressure CVD, disilane($Si_2H_6$) or trisilane($Si_3H_8$) was supplied to a CVD device, at a temperature of 450°–550° C., 100°–200° C. lower than the temperature of crystallization, e.g. at 530° C. The pressure in a reactor was 30–300 Pa, while the rate of film formation was 50–250 angstroms/minute. Boron may be added to the film at a concentration of $1\times10^{15}-1\times10^{18}cm^{-3}$ by means of diborane during the film formation, so as to set the threshold voltages (Vth) for PTFT and NTFT to almost an equal level.

Oxygen concentration in the film formed in this way is preferably not more than $5\times10^{21}cm^{-3}$. The oxygen concentration should be no more than $7\times10^{19}cm^{-3}$, or preferably no more than $1\times10^{19}cm^{-3}$, in order to promote crystallization, however, if the concentration is too low, leakage current in an OFF condition is increased due to the illumination of a back light, whereas, if the concentration is too high, crystallization will not be facilitated, and the temperature or time for laser annealing must be higher or longer thereby. The concentration of hydrogen was $4\times10^{20}cm^{-3}$ which was one atom % for the silicon at a concentration $4\times10^{22}cm^{-3}$.

Oxygen concentration should be not more than $7\times10^{19}cm^{-3}$ or preferably not more than $1\times10^{19}cm^{-3}$, so as to promote crystallization for source or drain, while oxygen may be ion-implanted only into the region that forms a channel of TFT constituting a pixel, at a concentration of $5\times10^{20}-5\times10^{21}cm^{-3}$.

The silicon film in an amorphous state was formed at a thickness of 500–5000 angstroms, or 1000 angstroms in this preferred embodiment, in the manner described above.

Patterning was carried out for a photoresist 53 using a mask P1 so as to open only the region for source or drain. A silicon film 54 was manufactured thereon as an n-type activation layer, by plasma CVD, at the temperature of film formation 250°–350° C,, e.g. 320° C. in the preferred embodiment 1, and monosilane($SiH_4$) and phosphine ($PH_3$) of mono-silane base at a concentration of 3% were used. These were introduced into the PCVD device at a pressure of 5 Pa, and the film was formed by applying high frequency power of 13.56 MHz. The high frequency power should be 0.05–0.20 W/cm$^2$ e.g. 0.120 W/cm$^2$ in the preferred embodiment 1.

The specific electric conductivity of the n-type silicon layer thus formed was approximately $2\times10^{-1}[\Omega\cdot cm^{-1}]$, while film thickness was 50 angstroms. Thus, the structure shown in FIG. 11(A) was obtained. The resist 53 was then removed using a lift-off method, and source and drain regions 55 and 58 were formed.

Figure 11C:
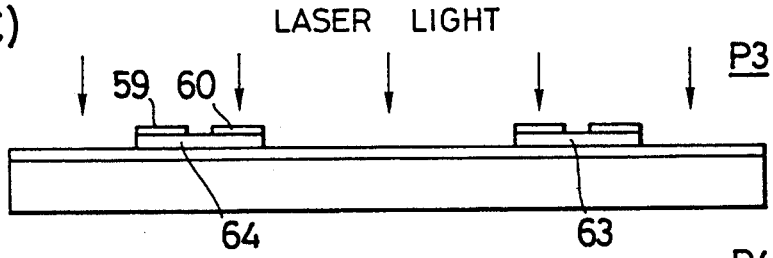

A p-type activation layer was formed in the same process. Mono-silane($SiH_4$) and diborane($B_2H_6$) of mono-silane base at a concentration of 5% were introduced in the PCVD device at the time at a pressure of 4 Pa, and the film was formed by applying high frequency power of 13.56 MHz. The high frequency power should be 0.05–0.20 W/cm$^2$ e.g. 0.120 W/cm$^2$ in the preferred embodiment 1. The specific electric conductivity of the p-type silicon layer thus formed was approximately $5\times10^{-2}[\Omega\cdot cm^{-1}]$, while the film thickness was 50 angstroms. Thus, the structure shown in FIG. 11(B) was obtained. Source and drain regions 59 and 60 were then formed by the lift-off method in the same way as for the n-type region. The silicon film 52 was thereafter etched off using a mask P3, and an island region 63 for N-channel thin film transistor and an island region 64 for P-channel thin film transistor were formed thereby as shown in FIG. 11(C).

The source, drain and channel regions were laser-annealed by XeCl excimer laser, and the activation layer was laser-doped at the same time. The threshold energy of the laser energy employed at the time was 130 mJ/cm$^2$ and 220 mJ/cm$^2$ is necessary as the laser energy in order to melt the film throughout thickness of the film. If the energy of no less than 220 mJ/cm$^2$ is irradiated from the start, however, hydrogen included in the film will be abruptly ejected, and the film will be damaged thereby. Thus the melting must be carried out only after hydrogen is first ejected at a low energy. In the first preferred embodiment, crystallization was carried out at an energy of 230 mJ/cm$^2$ after hydrogen was first purged out at 150 mJ/cm$^2$.

A silicon oxide film was formed as a gate insulating film thereon at a thickness 500–2000 angstroms, e.g. 1000 angstroms, under the same condition as for the silicon oxide film manufactured as a blocking layer. A small amount of fluorine may be added thereto at the time of film formation, so as to stabilize sodium ion.

Figure 11D:
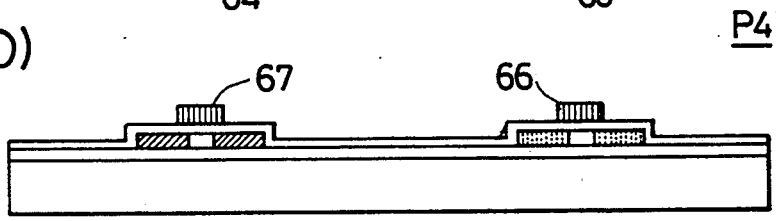

Further, a silicon film doped with phosphorus at a concentration $1-5\times10^{21}cm^{-3}$, or a multi-layered film comprising this silicon film and molybdenum (Mo), tungsten (W), $MoSi_2$ or $WSi_2$ film formed thereupon, was formed on the above-mentioned silicon oxide film, which was then subjected to a patterning process using a fourth photomask P4, and the structure shown in FIG. 11(D) was obtained thereby. A gate electrode 66 for NTFT, as well as a gate electrode 67 for PTFT were formed: as a gate electrode a phosphorus-doped silicon layer was formed at a thickness of 0.2 micrometer and a molybdenum layer was formed thereupon at a thickness of 0.3 micrometer, for example. The channel length was e.g. 7 μm.

In case of using aluminum (Al) as a gate electrode material, since a self-aligning process is available by anodic-oxidizing the surface of aluminum that is first patterned by a fourth photomask P4, the contact holes of source and drain can be formed closer to the gate, and TFT characteristic can be improved due to the increase in mobility as well as the reduction in threshold voltage.

In this way, C/TFT can be manufactured without elevating the temperature not less than 400° C., in every process. Therefore, there is no need to use an expensive material such as quartz as a substrate, and it can be said that this is a most suitable process for manufacturing the wide-screen liquid crystal display device in accordance with the present invention.

Figure 11E:
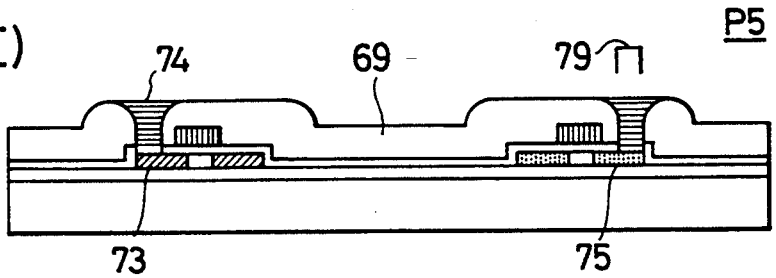
Figure 11F:
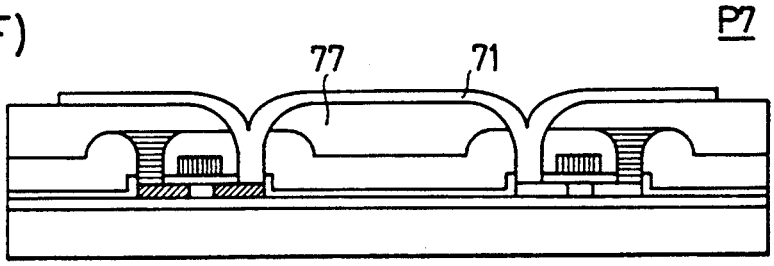
Figure 12A:
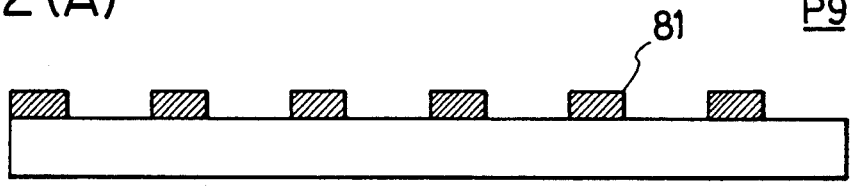
FIG. 12 shows a process of color filter in accordance with the preferred embodiment.
Figure 12B:
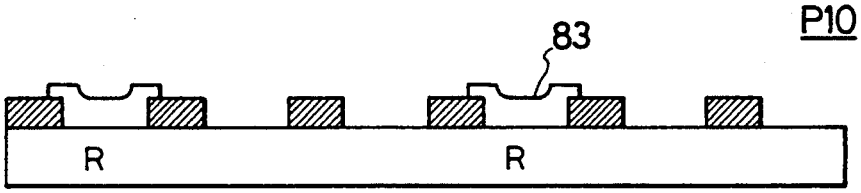
Figure 12C:
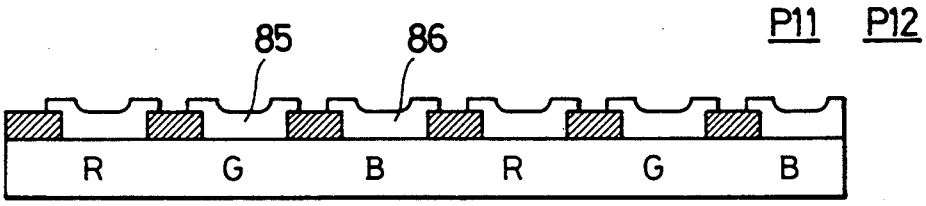
Figure 12D:
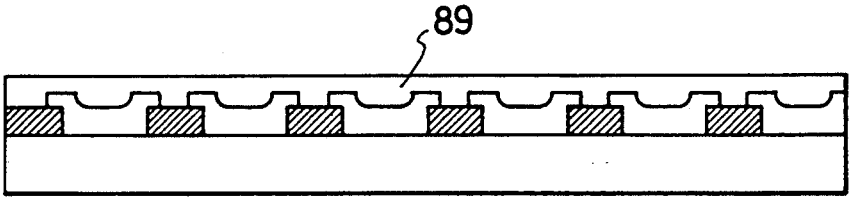
Figure 12E:
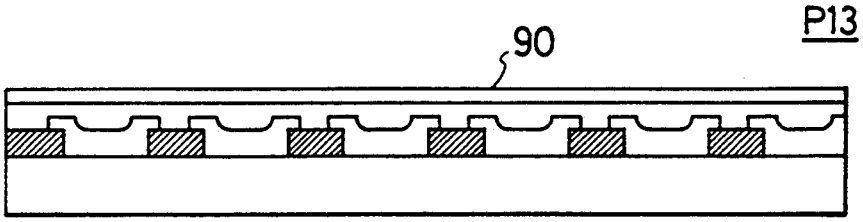

Referring to FIG. 11(E), an inter-layer insulating film 69 made of silicon oxide was formed by sputtering, in the manner described supra. The silicon oxide film can be formed by LPCVD, photo-CVD, or by atmospheric pressure CVD. The film was formed at a thickness of 0.2–0.6 micrometer, for example, and an opening 79 for electrode was formed using a fifth photomask P5. Aluminum was then sputtered over all of these at a thickness of 0.3 micrometer, and a lead 74 as well as contacts 73, 75 were formed using a sixth photomask P6, and thereafter an organic resin 77 for flattening or a transparent polyimide resin, for example, was applied to the surface thereof, and an opening of an electrode was formed again by a seventh photomask P7. An ITO (indium tin oxide) was sputtered over all of these, at a thickness of 0.1 micrometer, and a picture element electrode 71 was formed using an eighth photomask P8. The ITO was formed at a temperature ranging from room temperature to 150° C., and was then subjected to annealing process in oxygen or atmosphere at a temperature of 200°–400° C. Thus, the structure shown in FIG. 11(F) was obtained.

The electric characteristics of TFT thus obtained were: mobility was 40($cm^2$/Vs), and Vth −5.9(V) for PTFT, while mobility was 80($cm^2$/Vs), and Vth 5.0(V) for NTFT.

In this manner, one substrate for the electro-optical device was manufactured in accordance with the present invention.

The arrangement of the electrode, etc., of this liquid crystal display device is shown in FIG. 9. An N-channel thin film transistor and a P-channel thin film transistor are provided on the intersection of a first signal line 3 and a second signal line 4. The device has a matrix structure using such a C/TFT. The liquid crystal display device having picture elements as many as 640×480, 1280×960, or 1920×400 in this preferred embodiment, can be obtained by repeating such a structure horizontally and vertically. In this way, a first substrate was obtained.

The manufacturing method of the other substrate (a second substrate) is shown in FIG. 12. A polyimide resin for which a black pigment is mixed with polyimide was formed on a glass substrate at a thickness of 1 micrometer by a spin-coating method, and a black stripe 81 was manufactured by using a ninth photomask P9, whereafter, the polyimide resin mixed with a red pigment was formed at a thickness of 1 micrometer by the spin-coating method, and a red filter 83 was manufactured using a tenth photomask P10. A green filter 85 and a blue filter 88 were formed in the same manner, using masks P11 and P12. Each filter was baked in nitrogen at a temperature of 350° C., for sixty minutes, at the time of manufacturing thereof. A leveling layer 89 was then manufactured using transparent polyimide, again by spin-coating.

An ITO(indium tin oxide) was then sputtered over all of these at a thickness of 0.1 micrometer, and a common electrode 90 was formed using a thirteenth photomask P13. The ITO was formed at a temperature ranging from room temperature to 150° C., and was subjected to the annealing process in oxygen or atmosphere at a temperature of 200–300° C., and a second substrate was thus obtained.

A polyimide precursor was then printed on the abovementioned substrate using an offset method, and was baked in a non-oxidating atmosphere, e.g. in nitrogen, for an hour, at a temperature of 350° C. It was then subjected to a known rubbing method, and the quality of the polyimide surface was modified thereby, and whereby a means for orienting a liquid crystal molecule in a specific direction at least in an initial stage, was provided.

A nematic liquid crystal composition was sandwiched by the first and the second substrates formed in the way as described supra, and the periphery thereof was fixed with an epoxy bonding agent. A PCB having an electric potential wiring, a common signal and a TAB driver IC was connected to the lead on the substrate, while a polarizing plate was adhered to the outside, and a transmission-type liquid crystal electro-optical device was obtained thereby. A rear lightning device provided with three pieces of cold cathode tubes, and a tuner for receiving television radio wave, were connected to the liquid crystal electro-optical device, and the wall mounted television set was completed thereby. Since the device has a flatter shape than the conventional CRT television, it can be installed on the wall and the like. The operation of the liquid crystal television with an intermediate gradation display of 64 gradation levels was verified by applying the signal which is substantially equal to the one shown in FIGS. 1 and 2, to a liquid crystal picture element. The operation of the-present liquid crystal television with 258 gradation levels was also verified by applying the signal which is substantially equal to the one shown in FIGS. 3 to 5, to the liquid crystal picture element.

PREFERRED EMBODIMENT 2

An electro-optical device having a diagonal of one inch was used in this second preferred embodiment to manufacture a view finder for video camera, which will be explained infra:

In this embodiment, the number of picture elements was 387×128, and the device was formed using a high mobility TFT obtained by the process at a low temperature, and the view finder was formed thereby. The arrangement of the active device on the substrate of the liquid crystal electro-optical device in accordance with this preferred embodiment, is shown in FIG. 9, and manufacturing process therefor will be explained with reference to FIG. 13 showing cross sections taken along A–A′ and B–B′ lines of FIG. 9.

Figures 13A, 13B, 13C, 13D, 13E, 13F, 13G:
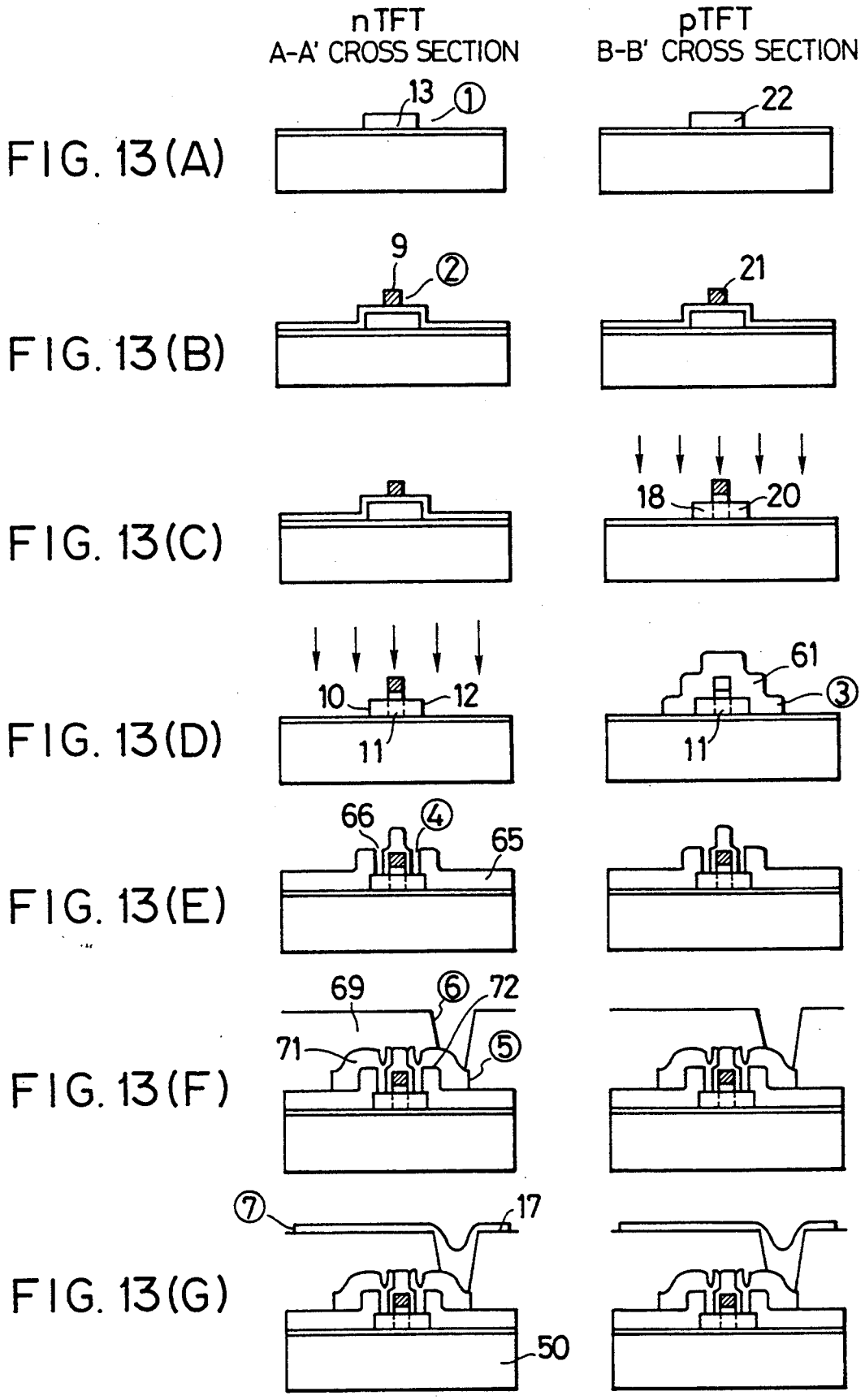
FIG. 13 shows a process of TFT in accordance with the preferred embodiment.

Referring to FIG. 13(A), a silicon oxide film as a blocking layer 51 was manufactured at a thickness of 1000–5000 angstroms by magnetron RF(high frequency) sputtering, on the inexpensive glass substrate 50 that bears heat treatment of no more than 700° C., e.g. approximately 600° C. The conditions for the process were: in 100% oxygen atmosphere; temperature for film formation was 15° C.; output was 400–800 W; pressure was 0.5 Pa; and, rate of film formation was 30–100 angstroms/min. when quartz or single crystalline silicon was used as a target.

A silicon film was then formed thereon by LPCVD(low pressure chemical vapor deposition), sputtering, or by plasma CVD. In case of using the low pressure chemical vapor deposition, film formation was carried out by supplying, for example, disilane ($Si_2H_6$) or trisilane ($Si_3H_8$) to a CVD device, at a temperature of 450°–550° C., 100°–200° C. lower than the temperature for crystallization, e.g. at 530° C. The pressure in a reactor was 30–300 Pa, while the rate of film formation was 50–250 angstroms/min. Boron may be added to the film by means of diborane at a concentration of $1\times10^{15}-1\times10^{18}cm^{-3}$, during the manufacture thereof, so as to control the threshold voltages (Vth) for PTFT and NTFT to almost equal value.

In case of using sputtering, film formation was carried out by defining the back pressure before sputtering as no more than $1\times10^{-5}$ Pa, and by using single crystalline silicon as a target, in the atmosphere in which 20–80% of hydrogen was mixed with argon; e.g. argon 20% and hydrogen 80%. The temperature for film formation was 150° C.; frequency was 13.56 MHz; sputtering output was 400–800 W; and, the pressure was 0.5 Pa.

In case of manufacturing silicon film by plasma CVD, the temperature was, for example, 300° C., and monosilane($SiH_4$) or disilane($Si_2H_6$) was used. These were introduced into the PCVD device, and high frequency power of 13.56 MHz was applied thereto.

After a silicon film in amorphous state was manufactured in this manner at a thickness of 500–5000 Å, e.g. at 1500 Å, it was subjected to middle temperature heat treatment in a non-oxidating atmosphere at a temperature of 450°–700° C., for 12–70 hours, or, for example, the film was maintained in a hydrogen atmosphere at a temperature of 600° C. Referring to FIG. 13(A), the silicon coated film was photo-etched by a first photomask 1, and a region 13 (channel width of 20 micrometer) for NTFT was manufactured on the side of the A–A′ cross section shown in the figure, and a region 22 for PTFT on the side of the B–B′ cross section.

A silicon oxide film was formed thereupon as a gate insulating film at a thickness of 500–2000 angstroms, e.g. at 1000 angstroms. The manufacturing condition was the same for the silicon oxide film as a blocking layer. A small amount of fluorine may be added to the film during the manufacturing thereof, so as to stabilize sodium ion.

A silicon film doped with phosphorus at a concentration $1-5\times10^{21}cm^{-3}$, or a multi-layered film comprising this silicon film and molybdenum (Mo), tungsten (W), $MoSi_2$ or $WSi_2$ film formed thereupon, was formed, which was then subjected to a patterning process using a second photomask 2, and the structure shown in FIG. 13(B) was thus obtained. A gate electrode 9 for NTFT, as well as a gate electrode 21 for PTFT were then formed. In this preferred embodiment: the channel length for NTFT was 10 micrometer; the channel length for PTFT was 7 micrometer. As a gate electrode, a P-doped Si layer was formed at a thickness of 0.2 micrometer and a molybdenum layer was formed thereupon by 0.3 micrometer.

Referring to FIG. 13(C), boron was ion-implanted at a dose of $1-5\times10^{15}cm^{-2}$, to a source 18 and a drain 20 for PTFT. Referring to FIG. 13(D), a photoresist 61 was then formed using a photomask 3. Phosphorus was ion-implanted at a dose of $1-5\times10^{15}cm^{-2}$, to a source 10 and a drain 12 for NTFT.

In case of using aluminum (Al) as a gate electrode material, since a self-aligning process is possible by anodic-oxidizing the surface of the aluminum which is primarily patterned by a second photomask 2, the contact holes of source and drain can be formed closer to the gate, and TFT characteristic can be further improved due to the increase in mobility as well as the reduction in threshold voltage.

Thermal annealing process was carried out again at a temperature of 600° C., for 10–50 hours. A source 10 and a drain 12 for NTFT as well as a source 18 and a drain 20 for PTFT were manufactured as N+ type and P+ type, respectively, by activating impurities. Channel forming regions 19 and 11 are formed as semi-amorphous semiconductors, under gate electrodes 21 and 9.

In this way, C/TFT can be manufactured without elevating the temperature not less than 700° C., in every process, though a self-aligning method is employed. Therefore, it is not necessary to use an expensive material such as quartz for the substrate, and it can be said that this is a most suitable process for manufacturing the wide-screen liquid crystal display device in accordance with the present invention.

Thermal annealing was carried out twice in this embodiment, as shown in FIGS. 13(A) and (D). The annealing process described in FIG. 13(A) may be omitted according to a desirable characteristic, and the time for manufacturing can be shortened by carrying out only the annealing process described in FIG. 13(D), instead of carrying out the two annealing processes. Referring to FIG. 13(E), a silicon oxide film was formed as an inter-layer insulating material 65 by sputtering in the manner as described supra. The silicon oxide film can be formed by LPCVD, photo-CVD, or by atmospheric pressure CVD, at a thickness of, for example, 0.2–0.8 micrometer, and an opening 88 for electrode was formed thereafter using a photomask 4. Aluminum was then sputtered over the entire surface as shown in FIG. 13(F), and after a lead 71 as well as a contact 72 were manufactured using a photomask 5, an organic resin 89 for flattening, or a transparent polyimide resin, for example, was applied to the surface, and an opening for electrode was formed again with a photomask 6.

An ITO (indium tin oxide) was formed by sputtering to connect a picture element transparent electrode (ITO) of the liquid crystal device with output terminals of the two TFTs in complementary structure. The ITO was then etched by a photomask 7, and an electrode 17 was thus formed. The ITO was formed at a temperature ranging from room temperature to 150° C., and was then subjected to annealing process in atmosphere or in an oxygen at 200°–400 ° C. NTFT 13, PTFT 22, and an electrode 17 of transparent conductive film were thus manufactured on the same glass substrate 50. The electric characteristics of the TFTs thus obtained were: mobility of 20($cm^2$/Vs), Vth of −5.9(V) for PTFT; and, mobility of 40($cm^2$/Vs), and Vth of 5.0(V) for NTFT.

In this manner, a first substrate for the liquid crystal device was manufactured. The arrangement of the electrode, etc., of the liquid crystal device is shown in FIG. 9. Thus the device has a matrix form using such a C/TFT.

An ITO(indium tin oxide) was then sputtered on a silicon oxide film 2000 angstroms thick, that was sputtered on a soda-lime glass substrate, so as to obtain a second substrate. The ITO was formed at a temperature ranging from room temperature to 150° C., and was then subjected to annealing process in atmosphere or in oxygen at a temperature of 200°–400° C. A color filter layer was then formed on the substrate in the same manner as described in the Preferred Embodiment 1, and thus the second substrate was formed.

A polyimide precursor was then printed on the above-mentioned substrate by an offset method, which was baked in a non-oxidating atmosphere, e.g. in nitrogen, for an hour, at a temperature of 350° C. The polyimide surface was then modified by a known rubbing method, and a means to align liquid crystal molecules in a certain direction at least in an initial stage, was provided, and the first and the second substrates were thus provided.

The nematic liquid crystal composition was sandwiched by the abovementioned first and second substrates, and the periphery thereof was fixed with an epoxy bonding agent. Bonds were carried out by COG method, since the pitch of the lead on the substrate was as small as 48 micrometer. In this embodiment, a gold bump provided on an IC chip was bonded by epoxy silver palladium resin, and an epoxy modified acrylic resin for solidification and sealing was buried between the IC chip and the substrate, so as to stabilize them. A polarizing plate was then adhered to the outside thereof, and a transmission type liquid crystal device was thus obtained.

The operation of the liquid crystal device with 64 gradation levels was verified by performing a driving method which is substantially the same as that shown in FIGS. 1 and 2.

PREFERRED EMBODIMENT 3

In this embodiment, a wall mounted television set manufactured by using a liquid crystal display device having a circuit structure as shown in FIG. 7, will be explained. Polycrystalline silicon subjected to laser annealing was used for TFT.

Figure 14A:
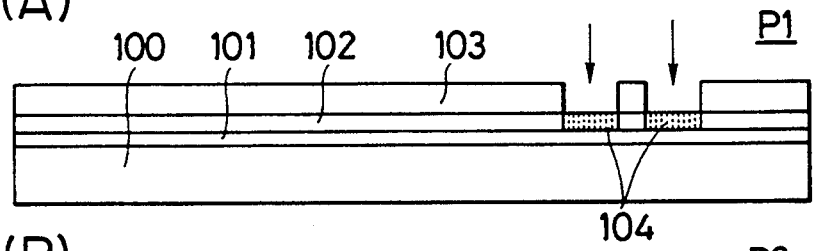
FIG. 14 shows a process of TFT in accordance with the preferred embodiment.
Figure 14B:
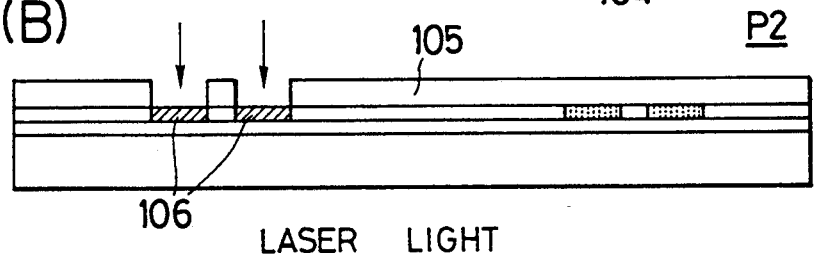
Figure 14C:
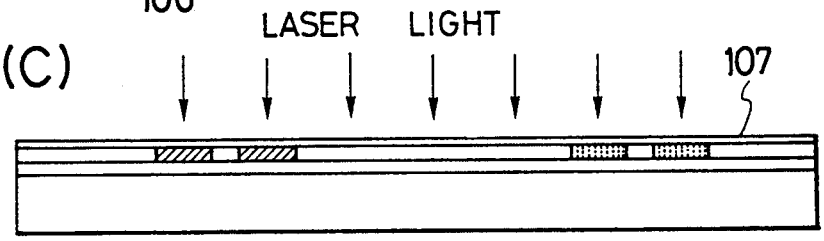
Figure 14D:
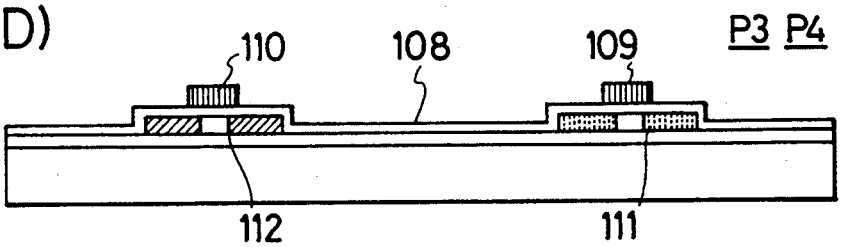

The manufacturing of a TFT part will be described infra according to FIG. 14. Referring to FIG. 14(A), a silicon oxide film was manufactured as a blocking layer 101 on an inexpensive glass substrate 100 which bears the heat treatment of not more than 700° C., e.g. approximately 600° C., at a thickness of 1000–3000 angstroms by magnetron RF(high frequency) sputtering. The conditions for the process were: in 100% oxygen atmosphere; the temperature for film formation was 15° C.; output was 400–800 W; and, pressure was 0.5 Pa. The rate of film formation was 30–100 angstroms/min, when quartz or single crystalline silicon was used as a target.

A silicon film 102 was manufactured thereon by plasma CVD. The temperature for film formation was 250°–350° C., e.g. 320° C. In this embodiment, monosilane ($SiH_4$) was used, however, disilane ($Si_2H_6$) or trisilane ($Si_3H_8$) can be used instead. These were introduced into a PCVD device at a pressure 3 Pa, and the film formation was carried out by applying high frequency power of 13.58 MHz thereto. The high frequency power should be 0.02–0.10 W/$cm^2$, or 0.055 W/$cm^2$ in this embodiment. The flow rate of monosilane ($SiH_4$) was 20SCCM, and the rate of film formation was approximately 120 angstroms/min. Boron may be added to the film by means of diborane during the film formation at a concentration of $1\times10^{15}-1\times10^{18}cm^{-3}$, so as to set the threshold voltages (Vth) for PTFT and for NTFT to almost equal level. When a silicon layer that will be a channel region of TFT is to be formed, sputtering or low pressure CVD can be employed instead of plasma CVD, which will be briefly described infra.

In case of sputtering, the back pressure before sputtering should be not more than $1\times10^{-5}$ Pa, and the sputtering was carried out in the atmosphere for which 20–80% of hydrogen was mixed with argon; e.g. 20% of argon and 80% of hydrogen. The target was single crystal silicon. The temperature for film formation was 150° C.; frequency was 13.56 MHz; sputtering output was 400–800 W; and, pressure was 0.5 Pa.

In case of carrying out low pressure CVD, film formation was carried out by supplying disilane ($Si_2H_6$) or trisilane ($Si_3H_8$) to a CVD device at a temperature of 450°–550° C., 100°–200° C. lower than the temperature for crystallization, e.g. at 530° C. The pressure in a reactor was 30–300 Pa. The rate of film formation was 50–250 angstroms/min. Boron may be added to the film by means of diborane during the film formation at a concentration of $1\times10^{15}-1\times10^{18}cm^{-3}$ so as to set the threshold voltages (Vth) for PTFT and for NTFT to almost equal level.

Oxygen in the film thus formed should be not more than $5\times10^{21}cm^{-3}$. Oxygen concentration should be not more than $7\times10^{19}cm^{-3}$ or preferably not more than $1\times10^{19}cm^{-3}$ so as to promote crystallization, however, if it is-too low, the leakage current in OFF state will be increased due to the illumination of a back light, thus the abovementioned level is supposed to be optimum. If oxygen concentration is too high, crystallization will not be facilitated, and the temperature for laser annealing must be higher or the time for laser annealing longer. Hydrogen concentration was $4\times10^{20}cm^{-3}$, or one atom % compared with the silicon at a concentration of $4\times10^{22}cm^{-3}$.

Oxygen concentration should be not more than $7\times10^{19}cm^{-3}$, preferably not more than $1\times10^{19}cm^{-3}$ in order to promote crystallization for source and drain, and oxygen can be ion-implanted only into channel forming regions of TFTs constituting pixels, at a concentration of $5\times10^{20}-5\times10^{21}cm^{-3}$. The silicon film in amorphous state was thus formed by 500–5000 angstroms, or by 1000 angstroms in this embodiment.

A photoresist pattern 103 having openings therein only over regions to be source and drain regions of NTFT was then formed by using a mask P1. Phosphorus ion was ion-implanted at concentrations $2\times10^{14}-5\times10^{16}cm^{-2}$ preferably at $2\times10^{16}cm^{-2}$ by using the resist 103 as a mask, and n-type impurity regions 104 were formed thereby, and the resist 103 was removed thereafter.

In the same way, a resist 105 was applied and a pattern thereof having openings therein only over regions to be source and drain regions of PTFT was formed by the use of a mask P2. p-type impurity regions were formed by using the resist 105 as a mask. Boron was ion-implanted as an impurity at a concentration of $2\times10^{14}-5\times10^{16}cm^{-2}$, or preferably by $2\times10^{16}cm^{-2}$. The structure shown in FIG. 14(B) was thus obtained.

A silicon oxide film 107 of 50–300 nm, e.g. 100 nm was then formed on the silicon film 102, by the abovementioned RF sputtering. Source, drain and channel regions were crystallized and activated through laser annealing using a XeCl excimer laser. The threshold level of the laser energy was 130 $mJ/cm^2$, and it should be 220 $mJ/cm^2$ so as to melt the entire film. If the energy of no less than 220 $mJ/cm^2$ is irradiated from the start, the film will be damaged, since the hydrogen existing in the film is abruptly ejected. For this reason, the film must be melted only after the hydrogen is purged out first at a low energy. In this embodiment, after hydrogen was purged out at an energy of 150 $mJ/cm^2$ crystallization was carried out at 230 $mJ/cm^2$ After the laser annealing was completed, the silicon oxide film 107 was removed.

Island-like NTFT region 111 and PTFT region 112 were then formed by a photomask P3. A silicon oxide film 108 was formed thereupon as a gate insulating film at a thickness of 500–2000 angstroms, e.g. 1000 angstroms. The manufacturing conditions were the same as for those of the silicon oxide film as a blocking layer. A little amount of fluorine may be added to the film during the manufacturing thereof, so as to stabilize sodium ion.

A silicon film containing therein phosphorus at a concentration of $1-5\times10^{21}cm^{-3}$ or a multi-layered film comprising this silicon film and a molybdenum (Mo), tungsten (W), $MoSi_2$ or $WSi_2$ film formed thereon, was formed thereupon. This was patterned by a fourth photomask P4, and the structure shown in FIG. 14(D) was thus obtained. A gate electrode 109 for NTFT and a gate electrode 110 for PTFT were formed. For example, the channel length was 7 micrometer and as a gate electrode phosphorus-doped silicon layer was formed at a thickness of micrometer and molybdenum layer was formed thereon at a thickness of 0.3 micrometer.

In case of using aluminum (Al) as a gate electrode material, since a self-aligning process is available by anodic-oxidating the surface of the aluminum which is primarily patterned by a fourth photomask P4, the contact holes of source and drain can be formed closer to the gate, and TFT characteristic is further improved due to the increase in mobility and the reduction in threshold voltage.

In this way, C/TFT can be manufactured without elevating the temperature no less than 400° C., in every process. Therefore, there is no need to use an expensive substrate such as a quartz, and it can be said that this is a most suitable process for the wide-screen liquid crystal display device in accordance with the present invention.

Figure 14E:
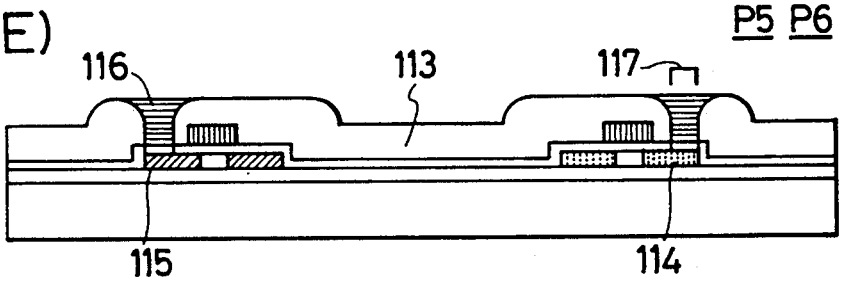
Figure 14F:
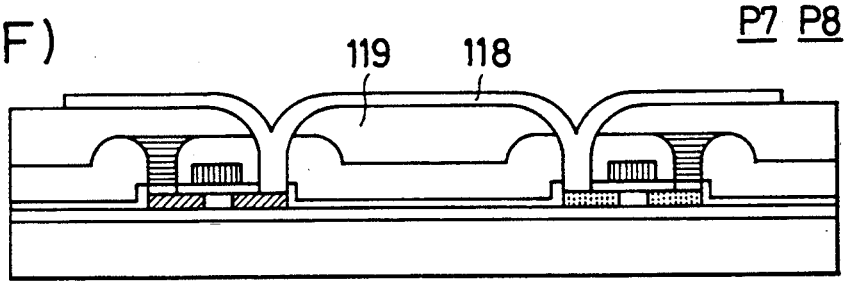

Referring to FIG. 14(E), a silicon oxide film was formed as an inter-layer insulator 113 by sputtering in the way described supra. The silicon oxide film can be formed by LPCVD, photo-CVD, or by atmospheric pressure CVD, at a thickness of 0.2–0.6 micrometer, for example, and an opening 117 for electrode was then formed by using a fifth photomask P5. Aluminum was further sputtered over the entire surface of these at a thickness of 0.3 micrometer, and, after a lead 116 and contacts 114 and 115 were manufactured by using a sixth photomask P6, an organic resin 119 for flattening, e.g. a transparent polyimide resin was applied to the surface thereof, and openings for electrodes were formed by using a seventh photomask P7. An ITO (indium tin oxide) was sputtered on the entire surface of these at a thickness of 0.1 micrometer, and a picture element electrode 118 was formed by using an eighth photomask P8. The ITO was formed at a temperature ranging from room temperature to 150° C., and was then subjected to annealing process in atmosphere or in oxygen at a temperature of 200°–400° C.

The electric characteristic of the TFTs thus obtained was: mobility of 35 ($cm^2/Vs$), Vth of −5.9(V) for PTFT, and mobility of 90 ($cm^2/Vs$), and Vth of 4.8(V) for NTFT.

In this way, a first substrate for the liquid crystal electro-optical device was obtained. The manufacture of the other substrate (a second substrate), which is the same as described in the preferred embodiment 1, is omitted here. A nematic liquid crystal composition was then sandwiched by the abovementioned first and second substrates, and the periphery thereof was fixed by an epoxy bonding agent. PCB having an electric potential wiring, a common signal, and a TAB-shaped driver IC were connected to the lead on the substrate, and a polarizing plate was adhered to the Outside, and a transmission type liquid crystal electro-optical device was thus obtained. A wall mounted television set was completed by connecting this device with a tuner for receiving television electric wave and a rear lighting device comprising three: pieces of cold cathode-ray tubes. Since the device becomes flatter compared with a conventional CRT type television, it can be installed on the wall and the like. The operation of this display device with 64 gradation levels was verified by applying the signal substantially the same as the one shown in FIGS. 4 and 5, to a liquid crystal picture element.

PREFERRED EMBODIMENT 4

In this embodiment, a wall rack television was manufactured by using a liquid crystal device utilizing the circuit structure as shown in FIG. 8, which will be described infra. Laser-annealed polycrystalline silicon was used in TFT.

Figure 10:
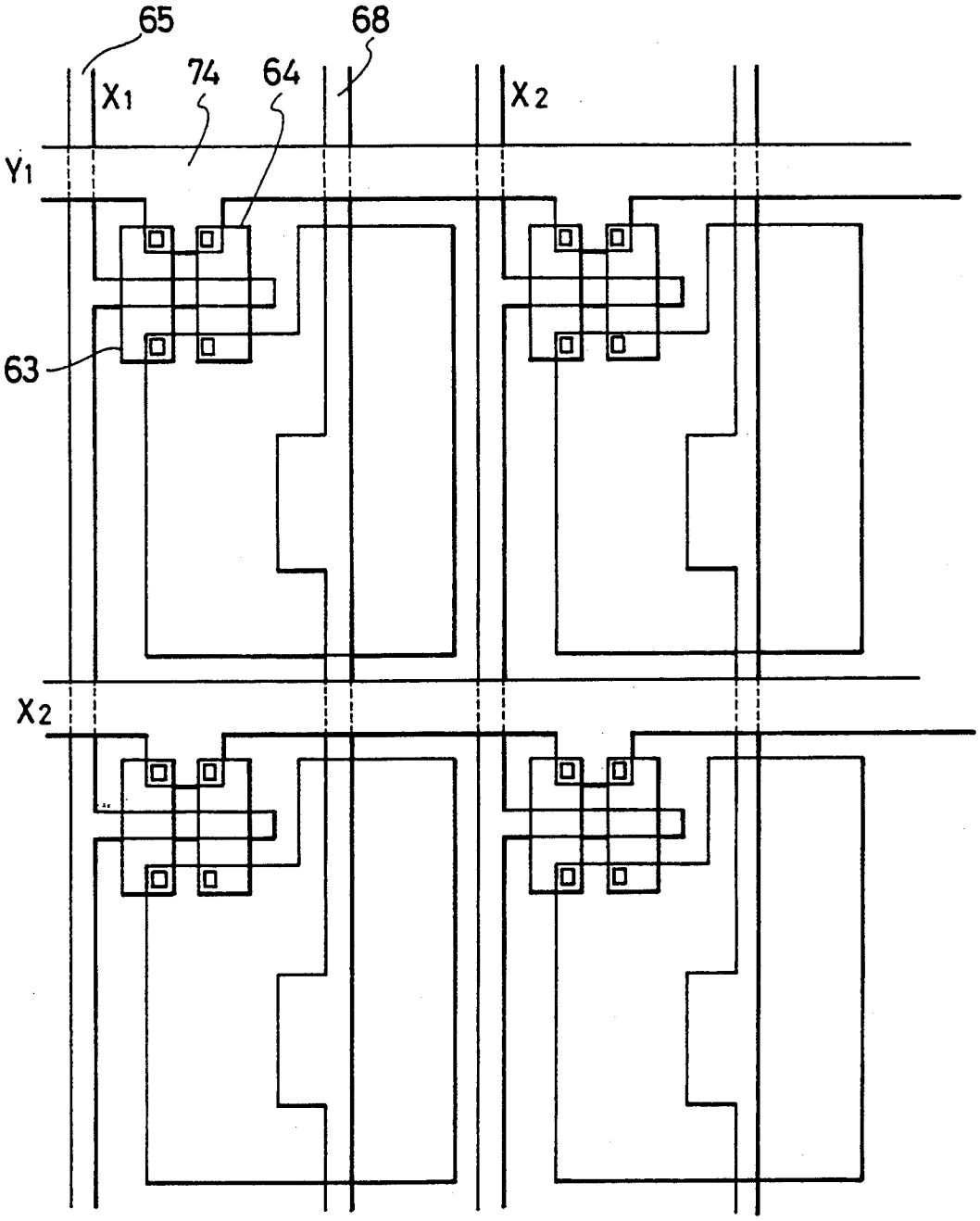
FIG. 10 shows an schematic diagram of a device in accordance with the preferred embodiment.

The actual arrangement and structure of electrodes etc. for this circuit structure are shown in FIG. 10, for one picture element. The manufacturing method of the liquid crystal panel used in this preferred embodiment will be first explained according to FIG. 11. Referring to FIG. 11 (A), a silicon oxide film was manufactured at a thickness of 1000–3000 angstroms as a blocking layer 51 by magnetron RF (high frequency) sputtering, on a glass substrate 50, which is not so expensive as quartz, and which can bear a thermal treatment at no more than 700° C., e.g. at approximately 600° C.

A silicon film 52 in an amorphous state was manufactured thereupon by plasma CVD, at a thickness of 500–5000 angstroms, or at 1000 angstroms in this preferred embodiment.

A photoresist pattern 53 having openings therein only over source and drain regions was formed using a mask P1, as shown in FIG. 11(A). A silicon film 54 that will be an n-type activation layer was manufactured thereupon, by plasma CVD. The specific electric conductivity of the n-type silicon layer thus formed was approximately $2\times10^{-1}[cm^{-1}]$, while film thickness was 50 angstroms. The resist 53 was then removed by a lift-off method, and source and drain regions 55 and 56 were thus formed.

A p-type activation layer was formed in the same process. The specific electric conductivity of the p-type silicon layer thus formed was approximately $5\times10^{-2}$[ohm $cm^{-1}$], while the film thickness was 50 angstroms. Source and drain regions 59 and 60 were then formed by using the lift-off method in the same way as for the n-type region. The silicon film 52 was etched off thereafter by using a mask P3, and an island region 63 for N-channel thin film transistor, and an island region 64 for P-channel thin film transistor were thus formed.

The source, drain and channel regions were laser-annealed by XeCl excimer laser, and the activation layer was laser-doped at the same time. A silicon oxide film was formed thereupon as a gate insulating film at a thickness of 500–2000 angstroms, e.g. at 1000 angstroms. Further, a silicon film containing phosphorus therein at a concentration of $1-5\times10^{21}cm^{-3}$ or a multi-layered film comprising this silicon film and molybdenum (Mo), tungsten (W), $MoSi_2$ or $WSi_2$ film formed thereupon, was formed on the abovementioned silicon oxide film, which was then patterned with a fourth photomask P4, and a gate electrode 66 for NTFT, as well as a gate electrode 67 for PTFT were formed. Regarding the size of the gate electrode, a channel length was, for example, 7 micrometer, and as a gate electrode a phosphorus-doped silicon layer was formed at a thickness of 0.2 micrometer and a molybdenum layer was formed thereupon at a thickness of 0.3 micrometer. A structure shown in FIG. 11(D) was thus obtained. At the same time, a gate wiring 65 and a wiring 68 arranged in parallel therewith were obtained by patterning, as shown in FIG. 11(D').

Besides the material mentioned supra, for example, aluminum (Al) can be used as a material for a gate electrode. In case of using aluminum, since a self-aligning process is available by anodic-oxidizing the surface of aluminum that is primarily patterned by the fourth photomask P4, the contact holes of source and drain can be formed closer to the gate, and TFT characteristic can be further improved because of increase of the mobility as well as reduction of the threshold voltage.

In this way, C/TFT can be manufactured without elevating the temperature to not less than 400° C., in every process. There is no need to use an expensive material such as quartz as a substrate, and it can be said that this is a most suitable process for manufacturing a wide-screen liquid crystal display device in accordance with the present invention.

In addition, an inter-layer insulating material 69 made of silicon oxide was formed by the abovementioned sputtering. The silicon oxide film can be formed by LPCVD, photo-CVD, or by atmospheric pressure CVD. The film was formed at a thickness of 0.2–0.6 micrometer, for example, while an opening 79 for electrode was formed by using a fifth photomask P5. Aluminum was then sputtered over all of these at a thickness of 0.3 micrometer, and a lead 74 as well as contacts 73 and 75 were manufactured using a sixth photomask P6. A structure shown in FIGS. 11(E) and (E') was thus obtained.

An organic resin 77 for flattening, e.g. a transparent polyimide resin was then applied to and formed on the surface thereof, and openings for electrodes were formed again by using a seventh photomask P7. An ITO (indium tin oxide) was sputtered over all of these, at a thickness of 0.1 micrometer, and a picture element electrode 71 was formed by using an eighth photomask P8. The ITO was formed at a temperature at room temperature or at other temperatures up to 150° C., and was then subjected to annealing process in atmosphere or in oxygen at a temperature of 200°–400° C. A structure shown in FIGS. 11(F) and (F') was thus obtained.

A cross section of A–A' of FIG. 11(F') is shown in FIG. 11(G). In practice, a counter electrode is provided on picture element electrodes 71 in such a way that a liquid crystal material is sandwiched between the counter electrode and the picture element electrodes 71, while a capacity is generated between the counter electrode and the picture element electrode 71, as shown in the figure. A capacity is also generated between the wiring 68 and the electrode 71 at the same time. By maintaining the wiring 68 in the same electric potential as the counter electrode, a circuit in which a capacity is inserted in parallel with a liquid crystal picture element, is formed, as shown in FIG. 8. By arranging in accordance with the preferred embodiment, the effect of reducing the damping or delay of the signal transmitted in a gate wiring, can be obtained, since the wiring 68 is in parallel with the gate wiring 65, and the parasitic capacity between the wirings is small.

Figure 15:
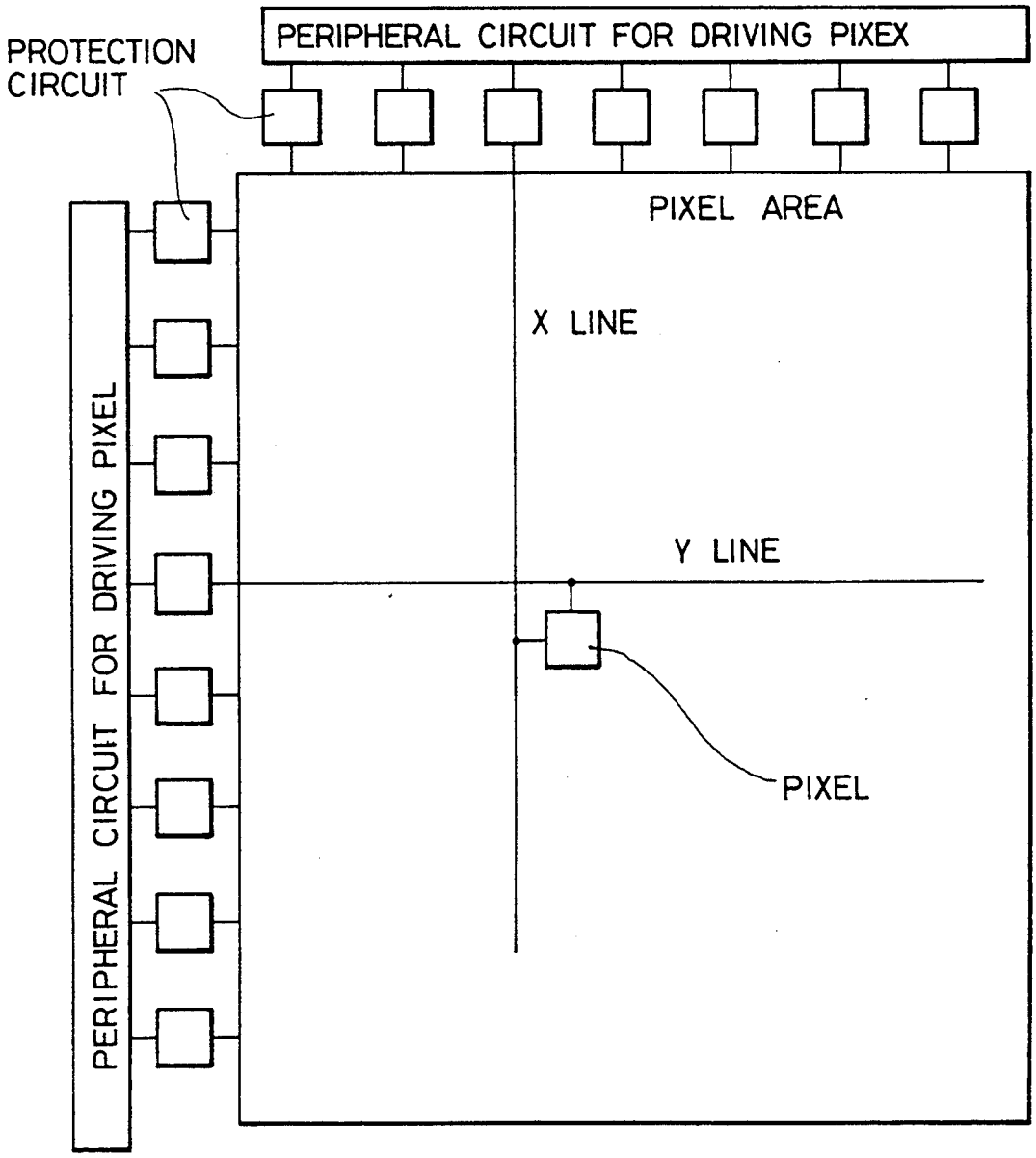
FIG. 15 shows a connection example of a protection network.
Figures 16A, 16B, 16C:
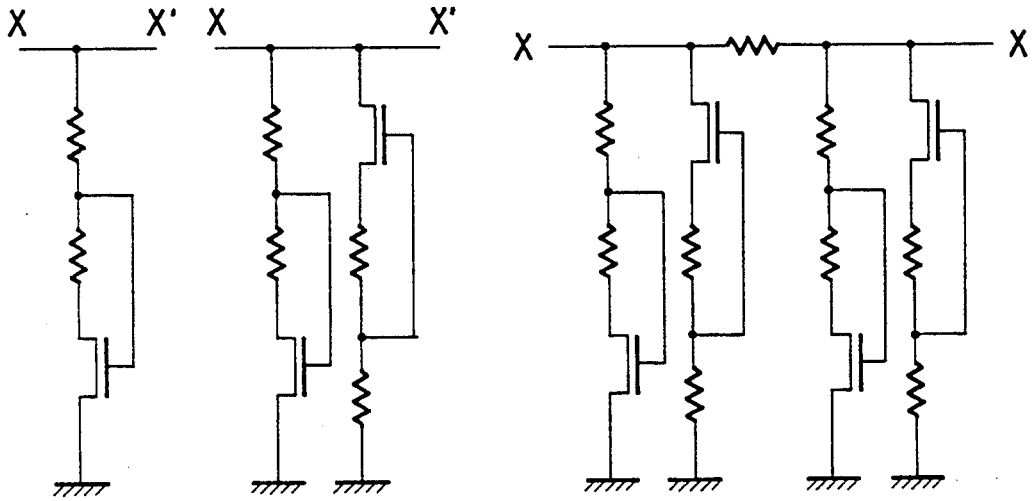
FIG. 16 shows examples of protection networks.
Figures 16D, 16E:
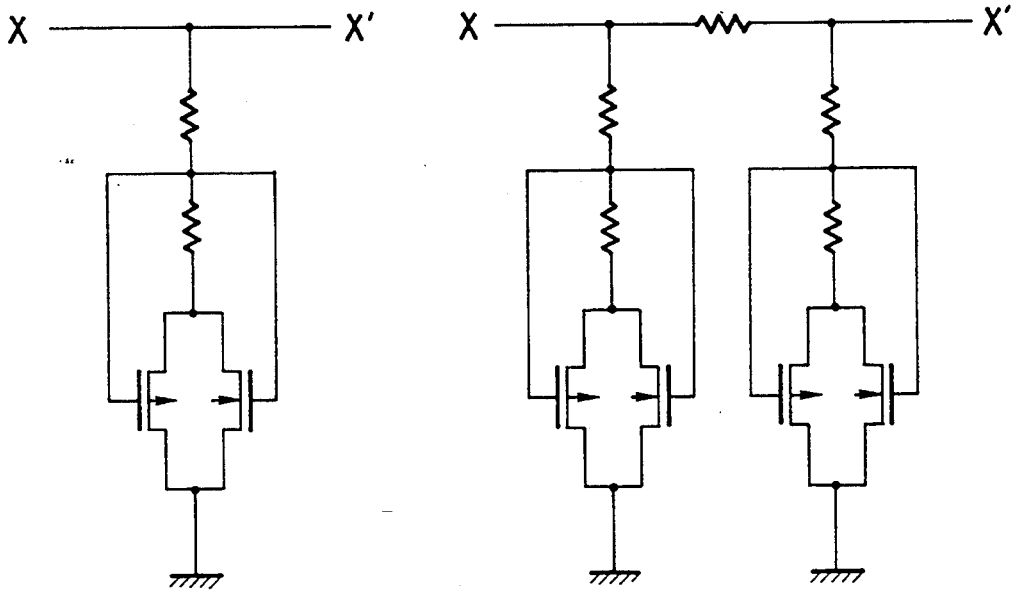
Figure 17A:
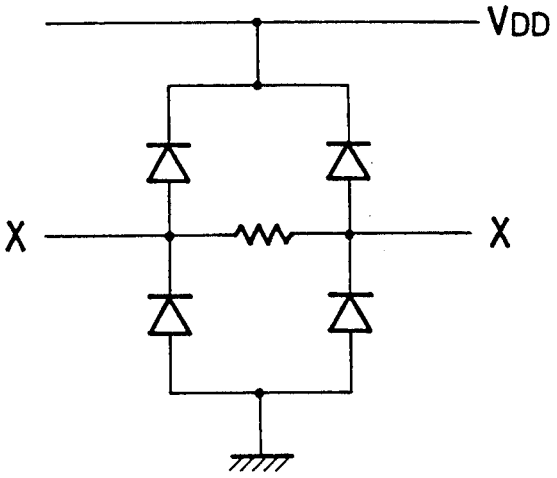
FIG. 17 shows examples of protection networks.
Figure 17B:
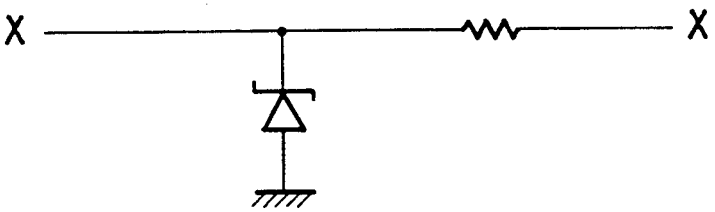

When the wiring 68 thus formed is to be used in a grounded form, it can be used as a grounding conductor of a protection network provided on the tailing end of each matrix wiring. The protection network is a circuit as shown in FIG. 15, for protecting CMOS, in particular, in a CMOS circuit, provided between a peripheral drive circuit and a picture element. The protection network is shown in FIGS. 16 and 17. Each one will be turned ON when an excessive voltage is applied to the wiring of the picture element, and remove voltage thereby. The protection network is formed out of a doped or un-doped semiconductor material (such as silicon), a transparent conductive material such as ITO, or of a general wiring material. This can be formed at the same time when the circuit of the picture element is formed.

This should be clear from the fact that each protection network shown in FIG. 16 comprises NTFT, PTFT, or C/TFT comprising these. Although the protection network shown in FIG. 17 does not utilize TFT, a diode has a structure of, for example, PIN junction, and the diode may have a structure such as NIN, PIP, PNP, or NPN for Zener effect, and it goes without saying that this can be manufactured by applying the manufacturing method presented in the preferred embodiment.

Regarding the electric characteristics of TFT thus obtained, mobility was 40($cm^2$/Vs), and Vth −5.9(V) for PTFT, and mobility was 80($cm^2$/Vs), and Vth 5.0(V) for NTFT.

In this manner, one substrate for the electro-optical device manufactured in accordance with the present invention, was obtained. The arrangement of the electrode, etc., of this liquid crystal display device is shown in FIG. 10. An N-channel thin film transistor and a P-channel thin film transistor are provided at the intersection of signal lines $Y_1$ and $X_1$. Thus the device has a matrix structure using the C/TFT as this. By repeating this structure horizontally and vertically, a liquid crystal display device of many picture elements e.g. of 640×480, or 1280×980, or 1920×400 in this preferred embodiment, can be obtained. A first substrate was thus obtained.

The manufacturing method of the other substrate (a second substrate) is the same as described in the other preferred embodiments, which will be omitted. By using the first and the second substrates, a wall rack television was manufactured in the same way as described in Preferred Embodiment 1, and the operation of 18 gradation display by the liquid crystal television was verified by applying the signal which was substantially the same as the one shown in FIGS. 1 and 2, to a liquid crystal picture element.

The present invention is characterized by the digital method of gradation display, compared with a conventional analog method of gradation display. In case of a liquid crystal electro-optical device having 640×400 dots of picture elements, it was with enormous difficulty to manufacture the device without difference in characteristic of every TFT that amounts to total 256,000 pieces, and in practice, a 16 gradations display is assumed to be an upper limit in consideration of mass productivity and yield. However, the display of not less than 256 gradations has become possible according to the present invention, without applying any analog signal at all, but through completely digital control. There are no ambiguity in gradation due to difference in characteristics of TFTs, for this method is a completely digital display, and even if there is any difference in characteristics of TFTs to some extent, a thoroughly homogeneous gradation display is possible. Since there is no more substantial problem with regard to the yield of TFT, according to the present invention, compared with a conventional method where there was substantial problem of poor yield at the time of manufacturing TFTs of little difference in its characteristics, the yield of the liquid crystal device is improved, while a manufacturing cost is drastically reduced, according to the present invention.

In case of carrying out conventional analog gradation display by a liquid crystal electro-optical device which is composed of 256,000 groups of TFTs of 640×400 dots in a 300 mm square, a 16 gradations display was an upper limit, for there was difference in characteristics of the TFTs by approximately ±10%. When a digital gradation display is carried out in accordance with the present invention, a 256 gradations display is possible, and a various and subtle color display of as many as 16,777,216 colors is achieved, being little influenced by difference in the characteristics of TFT devices. When a software of such as a television image is to be projected, a "rock", for example, of the same color should be subtly different in its color due to a lot of very small recesses and the like thereupon. When a display as close to the nature as possible is to be carried out, it is difficult with a 16-gradation display, however, the fine variation in color tone has become possible with the gradation display in accordance with the present invention.

Although the TFT utilizing silicon was primarily explained in the preferred embodiment in accordance with the present invention, the TFT utilizing germanium can be used in the same way. A single crystalline germanium is a most suitable material for implementing the present invention that requires high-speed operation, since the characteristics thereof exceed those of single crystalline silicon. Electron mobility of single crystalline germanium is 3600 $cm^2/Vs$, Hall mobility thereof is 1800 $cm^2/Vs$, whereas electron mobility of single crystalline silicon is 1350 $cm^2/Vs$, and Hall mobility thereof is 480 $cm^2/Vs$. The transition temperature of germanium from an amorphous state to crystal state, is lower than that of silicon, which means that germanium is suitable for low temperature process. The generation ratio of crystal nucleus at the time of growing germanium crystal is low, which means, in general, a large crystal can be obtained when it is grown into polycrystalline state. Germanium has thus a characteristic that can bear comparison with silicon's.

Although an electro-optical device utilizing liquid crystal, and, in particular, a display device utilizing liquid crystal are primarily referred to in order to explain a technical idea of the present invention, the idea of the present invention can be applied to a projection type television, as well as to other devices such as a photoswitch or a photoshutter, instead of display device. And it should be also clear that the present invention can be implemented by using any electro-optical material which is changed in its optical characteristic when electrically affected by electric field, voltage and so on, instead of by using liquid crystal. It is also clear that the present invention can be implemented by using other operational mode of liquid crystal including, for example, a guest-host mode, than the mode explained supra.

The foregoing description of preferred embodiments has been presented for purposes of illustration and description. It is not intended to be exhaustive or to limit the invention to the precise form described, and obviously many modifications and variations are possible in light of the above teaching. The embodiments were chosen in order to explain most clearly the principles of the invention and its practical application thereby to enable others in the art to utilize most effectively the invention in various embodiments and with various modifications as are suited to the particular use contemplated. Examples of such modifications are as follows.

Figure 23:
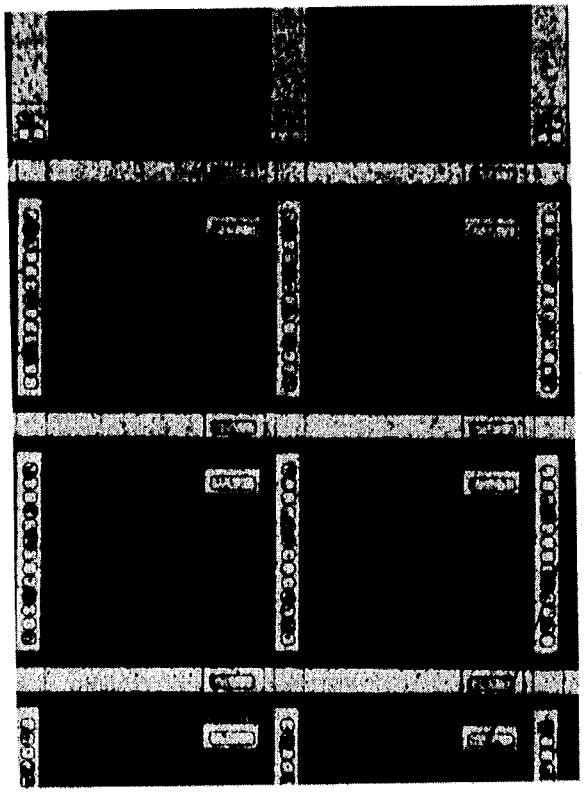
FIG. 23 is a copy of a photograph showing an electric circuit in accordance with the present invention.

FIG. 23 is a copy of a photograph showing an electric circuit which was actually manufactured in accordance with the present invention. Circuit diagram of this electric circuit is the same as that shown in FIG. 7. The electric circuit shown in FIG. 23 is a modification of the electric circuit shown in FIG. 9. The difference between them lies in shape of gate electrodes thereof, for example.

Figure 21:
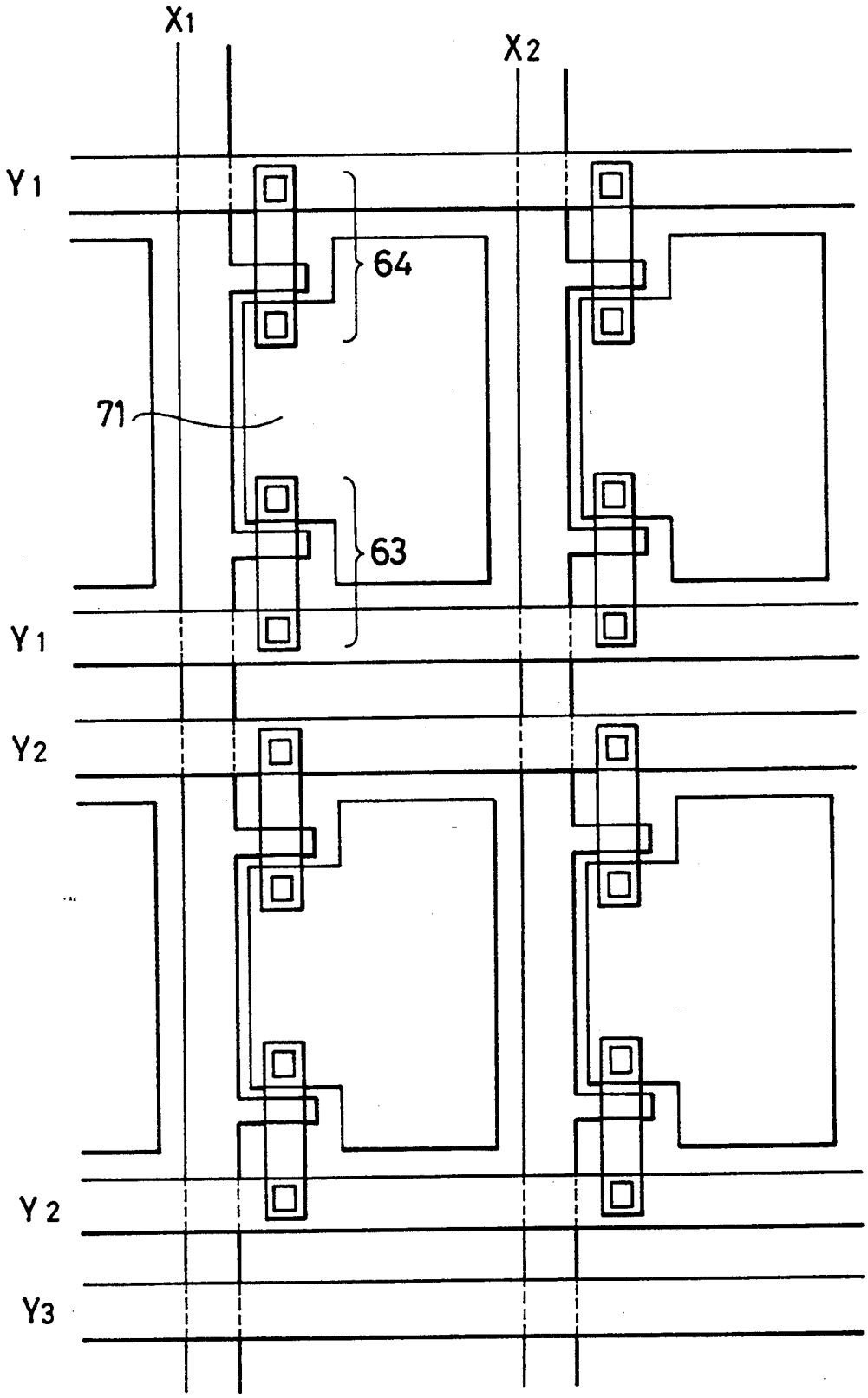
FIG. 21 shows a plan view of active devices in accordance with the present invention.
Figure 22:
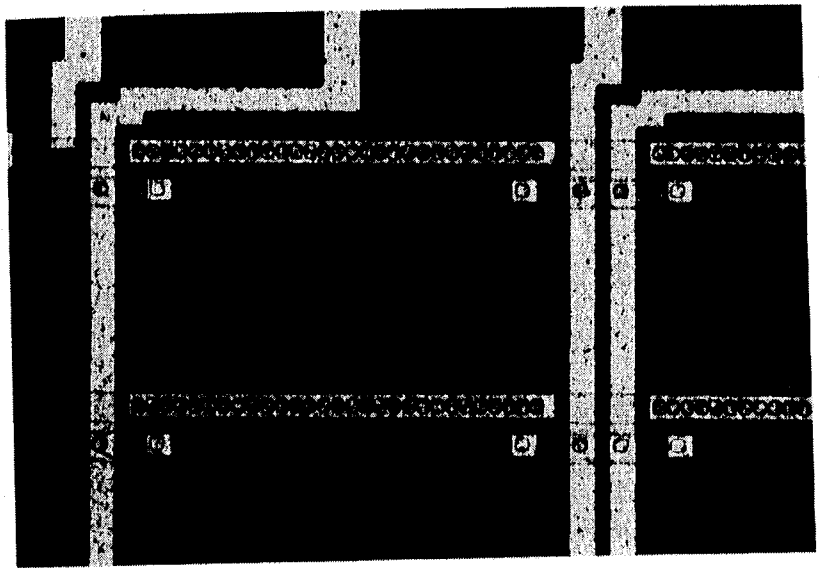
FIG. 22 is a copy of a photograph showing an electric circuit in accordance with the present invention.

FIG. 22 is a copy of a photograph showing an electric circuit which was actually manufactured in accordance with the present invention. Circuit diagram of this electric circuit is the same as that shown in FIG. 19. The electric circuit shown in FIG. 22 is a modification of the electric circuit shown in FIG. 21. The difference between them lies in shape of signal lines thereof, for example.

Figure 18A:
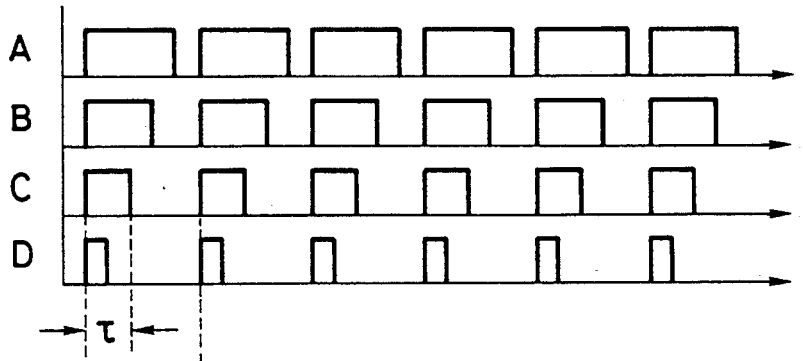
FIG. 18 shows an example of a drive waveform in accordance with the present invention.
Figure 18B:
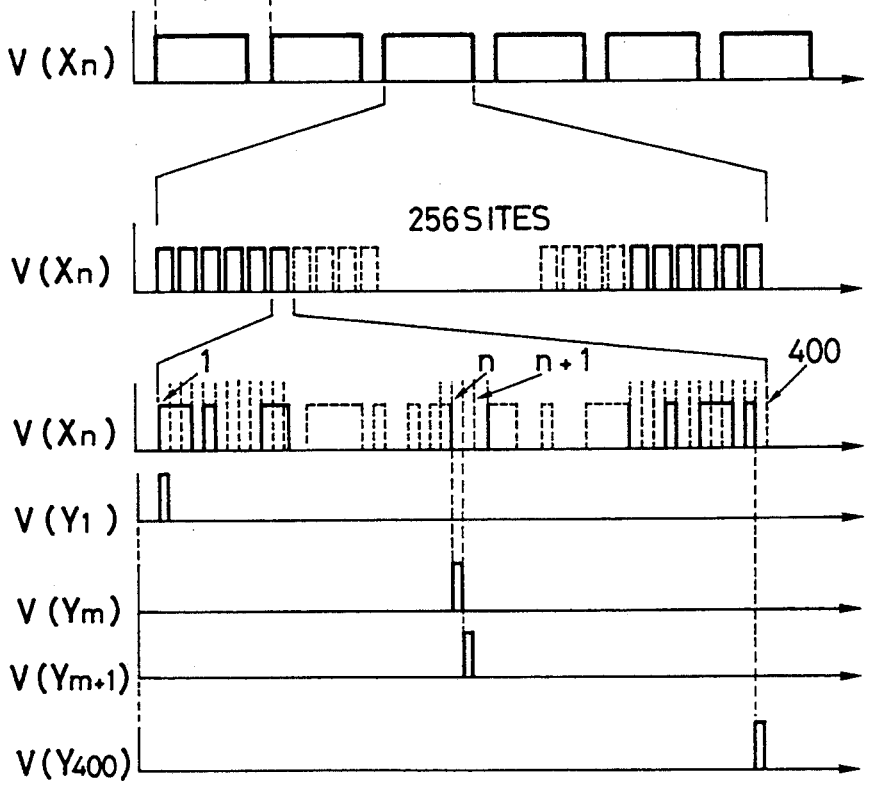
Figure 18C:
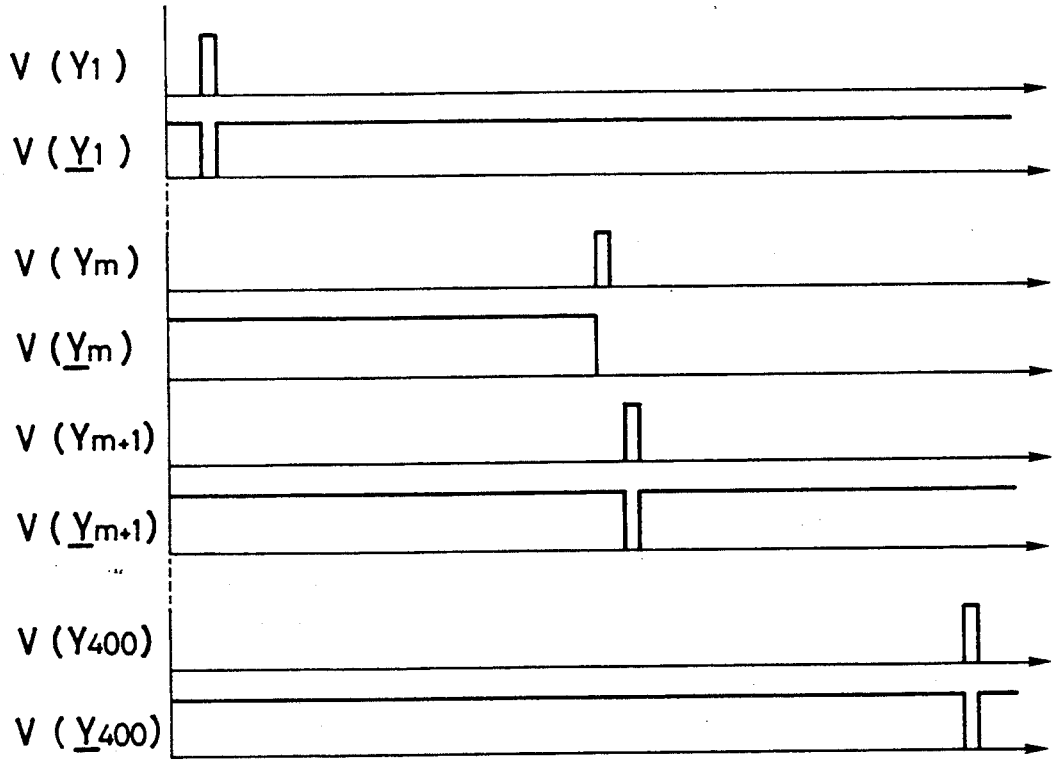

Other method of applying a pulsed voltage shown in FIG. 18(*a*), which is the same as a pulsed voltage shown in FIG. 1(*a*), to a liquid crystal cell is explained infra. For example, this method can be carried out by the driving method shown in FIGS. 18(*b*) and 20 in a liquid crystal display device comprising an active matrix circuit shown in FIG. 19.

Since response of an active device within 10 nsec. or shorter is needed in the present invention, a circuit capable of operating at a high speed has to be formed. For this reason, an inverter type circuit comprising NTFTs and PTFTs being assembled in a complementary arrangement as shown in FIG. 19 can be used for switching, rather than only NTFTs or only PTFTs as in the conventional circuit.

Figure 19:
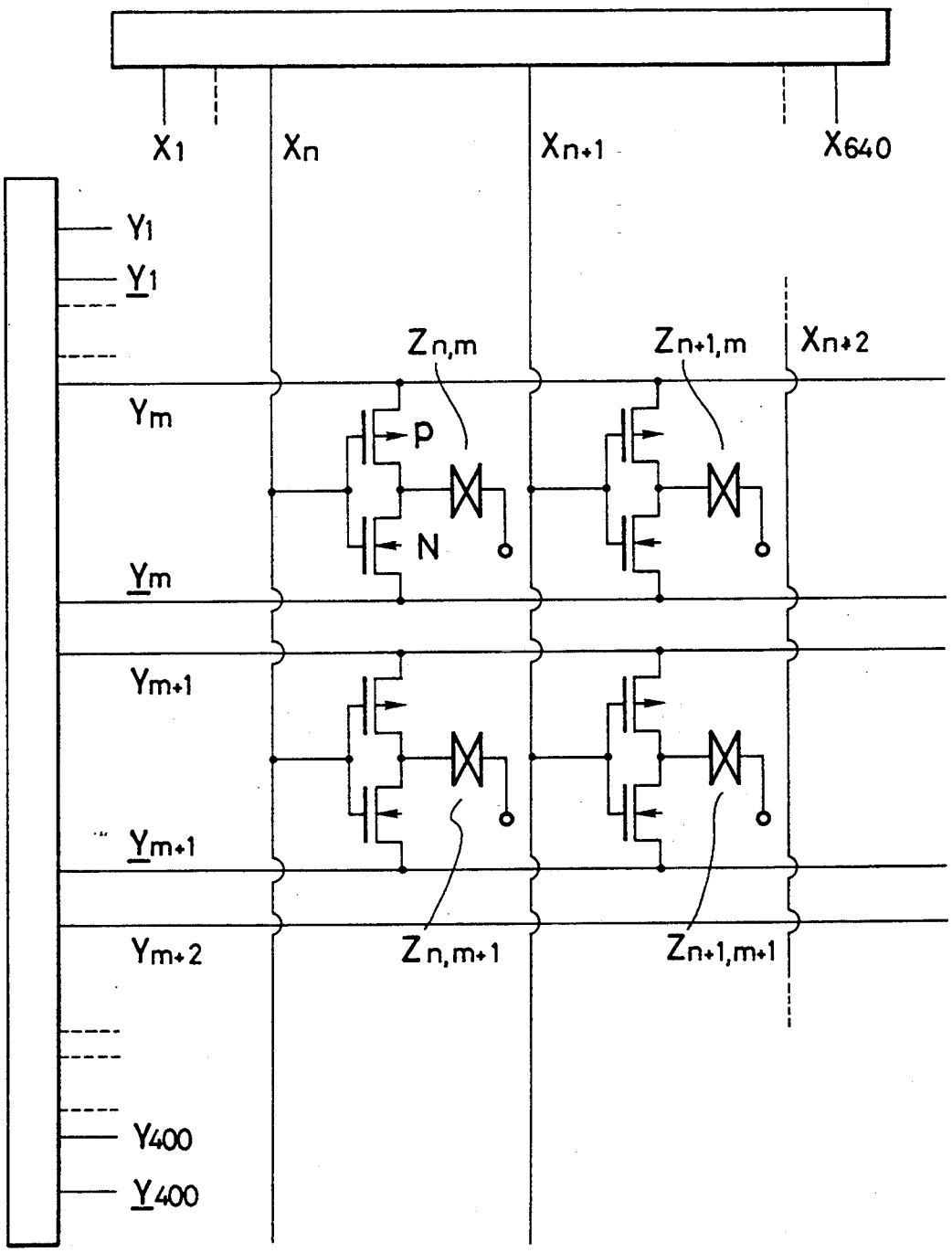
FIG. 19 shows an example of a matrix circuit in accordance with the present invention.

An N×M matrix type circuit is referred in this example, but only a part of it, i.e., the vicinity of the n-th row and the m-th column, is shown in FIG. 19 for the sake of simplicity. A mere repetition of this structure in the vertical and the horizontal direction provides a complete structure of the matrix.

Referring again to FIG. 19, there can be seen four inverter circuits shown in the figure. Each of the inverter circuits comprises at least one NTFT and at least one PTFT. The number of the TFTs can be increased to prepare for the case of malfunctioning. In the circuits, the gates of the NTFT and the PTFT are connected to a signal line $X_n$, and one of the source and drain of the NTFT is connected with the corresponding one of the source and drain of the PTFT to be further connected to the electrode of pixel $Z_{n,m}$. The remaining source or drain of the NTFT and the PTFT are each connected to signal lines $Y_m$ and $Y_m$. The signal lines $X_1, X_2, \ldots, X_N$ are collectively or individually referred to hereinafter as X line, and similarly, the signal lines $Y_1, Y_2, \ldots, Y_M$ are collectively or individually referred to hereinafter as Y line. Though not shown in FIG. 19, a capacitor may be intentionally incorporated in parallel with the pixel capacitor. The capacitor additionally incorporated into the circuit functions as a decelerator to decrease the rate of drop in pixel voltage ascribed to spontaneous discharge. The capacitor to be incorporated into the circuit preferably has a capacity of about several to 100 times the capacity of the pixel, more preferably, 10 times or less the capacity of the pixel capacitor. The presence of an excess capacity reversely hinders a high speed operation which is an object and also a characteristic point of the present invention.

Figure 20:
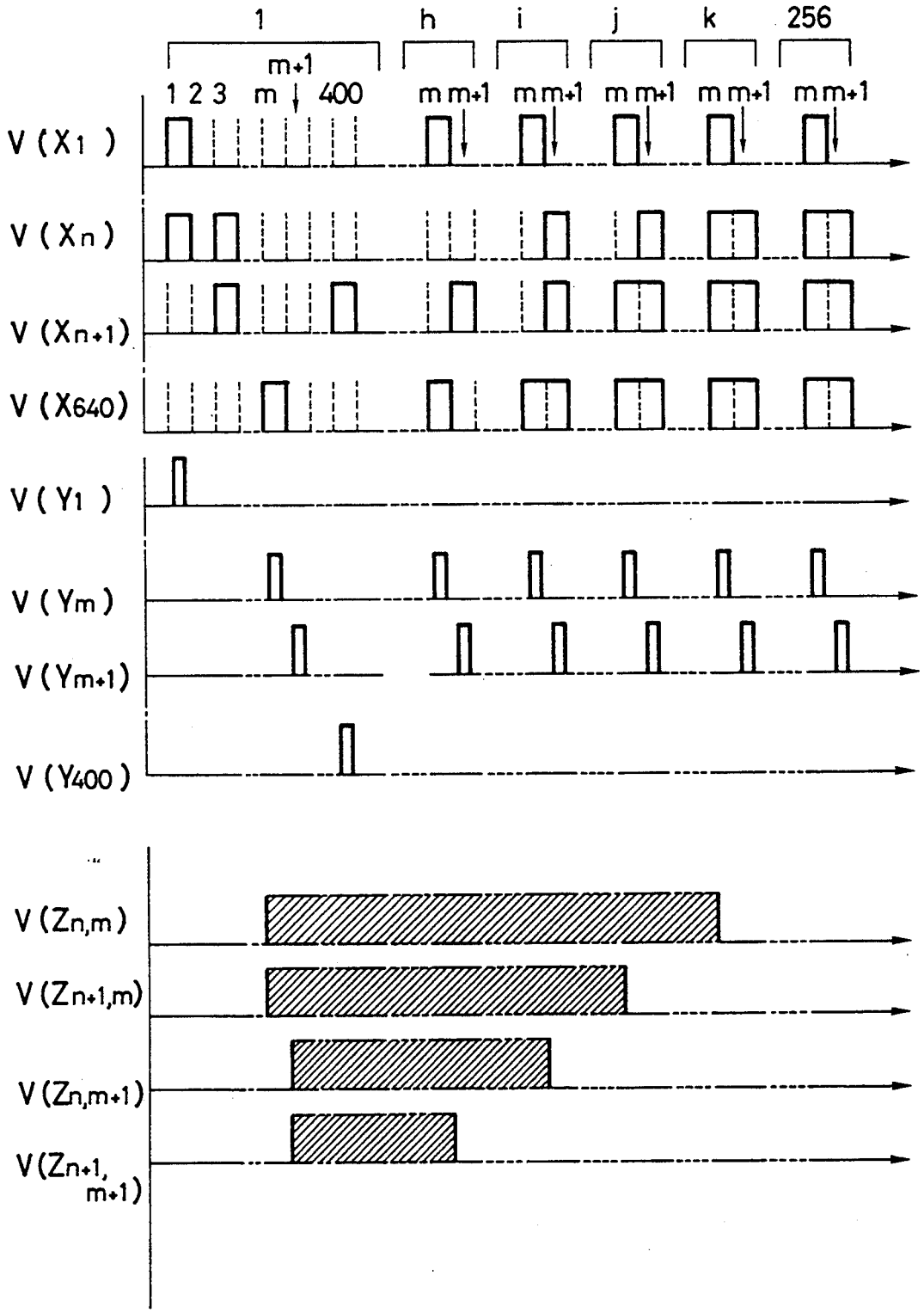
FIG. 20 shows an example of a drive waveform in accordance with the present invention.

Referring now to FIG. 18(*b*) and FIG. 20, an example of the mode of operation of the circuit shown in FIG. 19 is described. The matrix circuit should function as such to apply a pulsed voltage, as shown in FIG. 18(*a*), to the liquid crystal cell. In FIG. 18(*b*) are shown schematically signal voltages applied to X line and Y line in order to generate such a pulsed voltage. A 400×640 matrix is taken for an example below.

The signal applied to the X line is expressed by, for example, $V(X_n)$ in the case of the $X_n$ line. This signal can be readily understood that it comprises a pulse having a cycle T consisting of 256 pulses (referred to as sub-pulses, hereinafter), and that each of those sub-pulses is further made up from a pulse sequence having 400 elements. The number "400" corresponds to the number of lines (rows) in the matrix. Thus, if T=3 msec, the minimum unit of the pulse applied to the X line can be calculated as 29 nsec.

Meanwhile, pulses represented by $V(Y_1)$, $V(Y_m)$, $V(Y_{m+1})$, and $V(Y_{400})$ in the Figure are applied to the Y line sequentially within a duration of T/256, in such a manner that they would not completely overlap with each other. Those pulses should be further shorter than the minimum unit of the pulse applied to the X line mentioned hereinbefore. In short, 256 pulses are applied to each of the Y lines within a time duration of T. To the signal line $Y_m$, which constitutes a pair with the signal line $Y_m$, is applied a signal as shown in FIG. 1(C), so that it may complement the signal having applied to the signal line $Y_m$. In the description hereinafter, it should be understood without any explanation that a signal complementary (antiphase) to that applied to $Y_m$ is applied to $Y_m$.

Referring to FIG. 20, the mode of operation of the actual circuit is described below. First sub-pulses are applied to each of the X lines. Needless to say, but the sub-pulse is different for each of the X lines. On the other hand, pulses are applied to Y-lines one after another in the order of $Y_1$, $Y_2$, and so on. A case in which a pulse is applied to $Y_1$ is first considered. The active element connected to pixel $Z_{1,1}$ becomes turned OFF. That is, $Y_1$ at this point achieves a high voltage state (VH), whereas $Y_1$ falls in a state of low voltage (VL). Thus, the PTFT and NTFT function as an inverter. Furthermore, since the input $X_1$ to the inverter is $V_H$ in this case, the output comes out inverted and give $V_L$. Then, a voltage is applied to $Y_2$, and the pixel $Z_{1,2}$ achieves a high voltage state, because the input $X_1$ to the inverter is $V_L$. The $X_1$ maintains $V_L$, while the signals on $Y_2$ and each are inverted to $V_L$ and $V_H$, respectively. Thus, the PTFT and NTFT this time function as a buffer, and not as an inverter. Since $X_1$ achieves $V_L$ at this point, the circuit does not operate and the charge stored in the liquid crystal cell is maintained. Then, either of the signals $V_L$ or $V_H$ is applied to $X_1$, but the circuit would not function in both cases. Thus, the charge stored in the liquid crystal cell is further maintained. This state endures at least until $Y_1$ achieves $V_H$, and $Y_1$ achieves $V_L$ again. Similarly, $Z_{1,m}$, $Z_{1,m+1}$, and $Z_{1,400}$ achieve each a high voltage state and maintain the state.

In this manner pulses are applied one after another to the Y lines until $Y_m$ is reached. If four pixels, $Z_{n,m}$, $Z_{n,m+1}$, $Z_{n+1,m}$, and $Z_{n+1,m+1}$, are taken notice, the m-th and the (m+1)-th of the first sub-pulse of $X_n$ and $X_{n+1}$ are to be considered. Since the m-th element of both $X_n$ and $X_{n+1}$ are $V_L$, the pixels $Z_{n,m}$ and $Z_{n+1,m}$ each attain a high voltage (charged) state. Then a pulse is applied to $Y_{m+1}$. Since the (m+1)-th element of both $X_n$ and $X_{n+1}$ are $V_L$, the pixels $Z_{n,m+1}$ and $Z_{n+1,m+1}$ each attain also a high voltage (charged) state.

Though omitted in the Figure, the case in which a second sub-pulse is applied is considered. If the m-th and the (m+1)-th element in the pulse sequences of both $X_n$ and $X_{n+1}$ are $V_L$, the charged state remains and the four pixels maintains the state of high voltage. Then, let it be that all of the four pixels maintain the state of high voltage until they receive the (h−1)th sub-pulse.

When the h-th sub-pulse is applied the pixels $Z_{n,m}$ and $Z_{n+1,m}$ each are still maintained at a high voltage state because the m-th of both the $X_n$ and $X_{n+1}$ are $V_L$. For brevity's sake, other elements of the pulse sequences except the m-th and the (m+1)-th are omitted in FIG. 2. Since the (m+1)-th element of the pulse sequences of $X_{n+1}$ is $V_H$, the pixel $Z_{n+1,m}$ maintains the state of high voltage, whereas the active element of pixel $Z_{n+1,m+1}$ attains an output of low voltage state to discharge the stored charge and the high voltage state is interrupted.

A further application of an i-th sub-pulse to the X lines turns the (m+1)-th element of the $X_n$ to $V_H$, and releases the charged state of the pixel $Z_{n,m+1}$. Then, a j-th and a k-th subpulse each turn the m-th elements of both $X_{n+1}$ and $X_n$ to $V_H$. Thus the charged state of the pixels $Z_{n,m}$ and $Z_{n+1,m}$ is interrupted during application of the k-th and j-th sub-pulses. Such a process enables digital control of duration of the high voltage state for each of the pixels as shown in FIG. 20, V(Z).

As a result, the width of the pulse voltage applied to each of the pixels can be controlled arbitrarily by repeating this operation as shown in FIG. 18 (*a*).

Actual arrangement of electrodes etc. corresponding to the electric circuit shown in FIG. 19 is shown in FIG. 21. The liquid crystal display device comprising the electric circuit shown in FIG. 19 can be formed by the method similar to that of the first preferred embodiment or by the method similar to that of the third preferred embodiment, for example.

What is claimed is:

1. A method of driving an electro-optical device constructed with a pixel electrode; a data signal line; an n-channel transistor having a source, drain, and gate, and connected to said data line at one of said source and drain thereof and to said pixel electrode at the other one of said source and drain; and a p,channel transistor having a source, drain, and gate, and connected to said data line at one of said source and drain of said p-channel transistor and to said pixel electrode at the other one of said source and drain of said p-channel transistor, said method comprising the steps of:

applying a signal persisting from time $T_0$ to time $T_1$ to said data signal line;

applying a positive signal persisting for a period shorter than $(T_1-T_0)$ to a first one of the gates of said n-channel transistor and said p-channel transistor during duration of said signal applied to said data signal line;

applying a negative signal persisting for a period shorter than $(T_1-T_0)$ to a second one of said gates during duration of said signal applied to said data signal line;

applying no signal to said data signal line from time $T_2$ to time $T_3$ $(T_1<T_2<T_3)$; and applying a positive signal persisting for a period shorter than $(T_3-T_2)$ to said first gate during a period from said time $T_2$ to said time $T_3$; and applying a negative signal persisting for a period shorter than $(T_3-T_2)$ to said second gate during a period from said time $T_2$ to said time $T_3$.

2. The method of claim 1 wherein a voltage persisting at least from said time $T_1$ to said time $T_2$ is applied to a pixel electrode.

3. The method of claim 1 wherein said signal applied to said data signal line comprises a rectangular pulse.

4. A method of driving an electro-optical device comprising the steps of:

applying a unipolar pulse under a pulse period of 30 msec or shorter to a pixel electrode of a pixel with a duration of a time between a rising of said pulse and a falling of said pulse being controlled, where said pixel electrode is connected;is series with a thin film transistor of said pixel, and said unipolar pulse is applied through said thin film transistor.

5. The method of claim 4 wherein said duration is varied in said applying step.

6. The method of claim 4 wherein said pulse period is constant.

7. The method of claim 4 wherein said applying step is carried out by the steps of:

applying a signal persisting from time $T_0$ to time $T_1$ to a data signal line;

applying a signal persisting for a period shorter than $(T_1-T_0)$ and comprising two pulses having opposite polarities to an address signal line during duration of said signal applied to said data signal line;

applying no signal to said data signal line from time $T_2$ to time $T_3$ $(T_1<T_2<T_3)$; and applying a signal persisting for a period shorter than $(T_3-T_2)$ and comprising two pulses having opposite polarities to said address signal line during a period from said time $T_2$ to said time $T_3$.

8. A method of driving an electro-optical device constructed with a pixel electrode; a data signal line; an n-channel transistor having a source, drain, and gate, and connected to said data line at one of said source and drain thereof and to said pixel electrode at the other one of said source and drain; and a p-channel transistor having a source, drain, and gate, and connected to said data line at one of said source and drain of said p-channel transistor and to said pixel electrode at the other one of said source and drain of said p-channel transistor, said method comprising the step of:

applying pulses to at least one of said gates of said n-channel transistor and said p-channel transistor n-times at intervals, said intervals being $2^{i-1}T_1$ between the i-th pulse and the $(i+1)[-]$th pulse $(1<i<n-1)$ where i and n are natural numbers and $T_1$ is a constant time.

9. The method of claim 8 further comprising the step of applying a data signal to a data signal line.

10. The method of claim 9 wherein said data signal comprises a rectangular pulse.

11. The method of claim 8 wherein each of said pulses is a bipolar pulse comprising two pulse portions having opposite polarities.

12. A method of driving an electro-optical device constructed with a pixel electrode; a data signal line; a complemented signal line carrying a signal complementary to a signal on the data signal line; an n-channel transistor having a source, drain, and gate, and connected to said complemented signal line at one of said source and drain thereof and to said pixel electrode at the other one of said source and drain; and a p-channel transistor having a source, drain, and gate, and connected to said data signal line at one of said source and drain of said p-channel transistor, and to said pixel electrode at the other one of said source and drain of said p-channel transistor, said gates being connected to each other, said method comprising the steps of:

applying no signal to said gates from time $T_1$ to time $T_2$;

applying a positive signal to said gates from time $T_3$ to time $T_4(T_1<T_2<T_3<T_4)$;

applying a first positive pulse to said data signal line during a time between the time $T_1$ to the time $T_2$;

applying a second positive pulse to said data signal line during a time between the time $T_3$ and the time $T_4$;

applying no signal to said data signal line from a time of falling of said first positive pulse to a time of rising of said second positive pulse; and applying to said complemented signal line, at the time of applying said first and second positive pulses, signals complementary to said first and second positive pulses.

13. The method of claim 4, wherein said electro-optical device is constructed with a pixel electrode; a data signal line; an n-channel transistor having a source, drain, and gate, and connected to said data signal line at one of said source and drain thereof and to said pixel electrode at the other one of said source and drain; and a p-channel transistor having a source, drain, and gate, and connected to said data line at one of said source and drain of said p-channel transistor, and to said pixel electrode at the other one of said source and drain of said p-channel transistor wherein said rising is caused by the steps of:

applying a signal persisting from time $T_0$ to $T_1$ to said data signal line;

applying a positive signal persisting for a period shorter than $(T_1-T_0)$ to a first one of the gates of said n-channel transistor and said p-channel transistor during duration of said signal applied to said data signal line; and applying a negative signal persisting for a period shorter than $(T_1-T_0)$ to a second one of said gates during duration of said signal applied to said data signal line, and wherein said falling is caused by the steps of:

applying no signal to said data signal line from time $T_2$ to time $T_3$ $(T_1<T_2<T_3)$;

applying a positive signal persisting for a period shorter than $(T_3-T_2)$ to said first gate during a period from said time $T_2$ to said time $T_3$; and applying a negative signal persisting for a period shorter than $(T_3-T_2)$ to said second gate during a period from said time $T_2$ to said time $T_3$.

14. The method of claim 1 wherein all of said signals applied to said gates are applied to both said p-channel transistor gate and said n-channel transistor gate.

15. The method of claim 14 wherein said signals are applied to said gates through a single control line.

16. The method of claim 13 wherein all of said signals applied to said gates are applied to both said p-channel transistor gate and said n-channel transistor gate.

17. The method of claim 16 wherein said signals are applied to said gates through a single control line.

18. The method of claim 8 wherein pulses are applied to both said p-channel transistor gate and said n-channel transistor gate.

19. The method of claim 18 wherein said pulses are applied to said gates through a single control line.

20. A method of driving an electro-optical device comprising the steps of:

applying a signal persisting from time $T_0$ to time $T_1$ to a data signal line;

applying a signal persisting for a period shorter than $(T_1-T_0)$ and comprising two pulses having opposite polarities to an address signal line during duration of said signal applied to said data signal line;

applying no signal to said data signal line from time $T_2$ to $T_3$ $(T_1<T_2<T_3)$; and applying a signal persisting for a period shorter than $(T_3-T_2)$ and comprising two pulses having opposite polarities to said address signal line during a period from said time $T_2$ to said time $T_3$;

wherein a pulse is applied to a pixel electrode connected in series with a thin film transistor which is connected with said data signal line and said address signal line.

21. A method of driving a electro-optical device comprising the step of:

applying pulses to a gate of a thin film transistor connected in series with a pixel electrode n-times at intervals, said intervals being $2^{i-1}T_1$ between the i-th pulse and the (i+1) the pulse $(1<i<n-1)$ where i and n are natural numbers and $T_1$ is a constant time.

* * * * *